US008427306B2

(12) United States Patent
Mizoguchi et al.

(10) Patent No.: US 8,427,306 B2
(45) Date of Patent: Apr. 23, 2013

(54) ARTICLE MANAGEMENT SYSTEM

(75) Inventors: Takafumi Mizoguchi, Atsugi (JP); Hidetomo Kobayashi, Isehara (JP)

(73) Assignee: Semiconductor Energy Laboratory Co., Ltd., Atsugi-shi, Kanagawa-ken (JP)

( * ) Notice: Subject to any disclaimer, the term of this patent is extended or adjusted under 35 U.S.C. 154(b) by 179 days.

(21) Appl. No.: 11/979,993

(22) Filed: Nov. 13, 2007

(65) Prior Publication Data

US 2008/0111678 A1 May 15, 2008

(30) Foreign Application Priority Data

Nov. 14, 2006 (JP) ..... 2006-308096

(51) Int. Cl.
*G08B 1/08* (2006.01)

(52) U.S. Cl.
USPC ..... 340/539.15; 340/539.11; 340/568.7; 340/572.1

(58) Field of Classification Search .... 340/573.3–573.4, 340/539.11–539.23, 568.1–572.7, 457
See application file for complete search history.

(56) References Cited

U.S. PATENT DOCUMENTS

| | | | | |
|---|---|---|---|---|
| 5,781,109 | A * | 7/1998 | Nakajima | 340/571 |
| 6,956,480 | B2 * | 10/2005 | Jespersen | 340/568.1 |
| 6,992,587 | B2 | 1/2006 | Maeda et al. | |
| 7,009,512 | B2 * | 3/2006 | Cordoba | 340/539.23 |
| 7,042,357 | B2 | 5/2006 | Girvin et al. | |
| 7,283,054 | B2 | 10/2007 | Girvin et al. | |
| 7,323,998 | B2 | 1/2008 | Girvin et al. | |
| 2002/0174336 | A1 * | 11/2002 | Sakakibara et al. | 713/172 |
| 2003/0122671 | A1 | 7/2003 | Jespersen | |
| 2004/0189470 | A1 | 9/2004 | Girvin et al. | |
| 2004/0257229 | A1 | 12/2004 | Girvin et al. | |
| 2005/0130389 | A1 | 6/2005 | Yamazaki et al. | |
| 2005/0133790 | A1 | 6/2005 | Kato | |
| 2005/0134463 | A1 | 6/2005 | Yamazaki | |

(Continued)

FOREIGN PATENT DOCUMENTS

| | | |
|---|---|---|
| EP | 1 452 997 | 9/2004 |
| JP | 2002-319074 | 10/2002 |

(Continued)

OTHER PUBLICATIONS

International Search Report (Application No. PCT/JP2007/071672) dated Dec. 11, 2007.

(Continued)

*Primary Examiner* — Brent Swarthout
(74) *Attorney, Agent, or Firm* — Eric J. Robinson; Robinson Intellectual Property Law Office, P.C.

(57) ABSTRACT

The present invention is an article management system using a central management device with an interrogator and an alarm portion. Because the central management device and a central response device worn by a user of the system are provided separately, loss of the central management device can be prevented. The central response device is worn by a user. The central response device communicates with the central management device wirelessly and includes a detector that detects when the communication distance reaches or exceeds a given value and an alarm portion that notifies the user of this. The central management device communicates wirelessly with one or more articles in which a response device is installed.

22 Claims, 23 Drawing Sheets

U.S. PATENT DOCUMENTS

| | | | | |
|---|---|---|---|---|
| 2005/0146435 | A1 | 7/2005 | Girvin et al. | |
| 2005/0166436 | A1 | 8/2005 | Girvin et al. | |
| 2005/0174975 | A1* | 8/2005 | Mgrdechian et al. | 370/338 |
| 2005/0190098 | A1 | 9/2005 | Bridgelall et al. | |
| 2005/0219052 | A1* | 10/2005 | Chaco | 340/572.1 |
| 2005/0248458 | A1 | 11/2005 | Girvin et al. | |
| 2006/0044147 | A1 | 3/2006 | Knox et al. | |
| 2006/0176178 | A1* | 8/2006 | Everest et al. | 340/572.1 |
| 2006/0187065 | A1 | 8/2006 | Girvin et al. | |
| 2006/0251442 | A1* | 11/2006 | Fuqua et al. | 399/80 |
| 2006/0290484 | A1 | 12/2006 | Bauchot et al. | |
| 2007/0073513 | A1 | 3/2007 | Posamentier | |
| 2007/0075873 | A1 | 4/2007 | Yang et al. | |
| 2007/0120751 | A1 | 5/2007 | Saito et al. | |
| 2008/0021519 | A1* | 1/2008 | De Geest et al. | 607/58 |

FOREIGN PATENT DOCUMENTS

| | | |
|---|---|---|
| JP | 2004-013789 | 1/2004 |
| JP | 2004-246696 | 9/2004 |
| JP | 2006-004257 A | 1/2006 |
| JP | 2006-092256 A | 4/2006 |
| JP | 2006-521636 | 9/2006 |
| JP | 2007-072658 | 3/2007 |
| WO | WO 2004/095053 | 11/2004 |

OTHER PUBLICATIONS

Written Opinion (Application No. PCT/JP2007/071672) dated Dec. 11, 2007.

European Search Report (Application No. 07831403.6) dated Feb. 8, 2011.

* cited by examiner

ARTICLE MANAGEMENT SYSTEM

TECHNICAL FIELD

The present invention relates to a system that uses wireless communication devices. In particular, the present invention relates to a system, which uses wireless communication, that is used to prevent loss of articles.

BACKGROUND ART

In recent years, technology for the identification of individual objects in which identification information for individual objects (IDs) is assigned to each object and information about the history or the like of the object is specified has been attracting attention. In particular, development of semiconductor devices by which data can be transmitted and received by non-contact using wireless communication by electromagnetic waves has been actively pursued. These kinds of semiconductor devices by which data can be communicated wirelessly are called IC tags, RFID tags, and the like and are being gradually introduced into the marketplace with the objective of, for example, article management.

Presently, many of the semiconductor devices, called IC tags and the like, by which data can be communicated wirelessly, that are being put into practical use have element formation portions with desired circuits formed of transistors and the like and have antenna portions electrically connected to the element formation portions. These kinds of semiconductor devices, by which data can be communicated wirelessly, communicate with an interrogator (also called a reader/writer) wirelessly via electromagnetic waves and can thereby be made to operate by reception of data and power of a power supply from the interrogator. For wireless communication between the interrogator and the semiconductor device, generally, carrier waves modulated by a device on the transmission side are transmitted to a device on the reception side, the device on the reception side receives these carrier waves, and the device on the reception side extracts data by demodulation of the carrier waves, and so, information is transmitted and received thusly.

Article management systems by which communication between an interrogator and a response device is performed wirelessly using an interrogator provided in a wireless communication device that can be carried and a response device that responds to the interrogator are well-known. For the interrogator, an electronic device capable of wireless communication (for example, a cellular phone) is used, and for the response device, an IC tag or the like is used (for examples, refer to Patent Document 1).

Patent Document 1: Japanese Published Patent Application No. 2004-13789

DISCLOSURE OF INVENTION

However, with a conventional article management system that uses wireless communication, it is assumed that the interrogator is usually carried by a user (the user is also referred to as the holder of the article, hereinafter referred to as simply "user" throughout the present specification, and it is to be noted that the user is a human being) of the system, and nothing can be done to prevent loss of the interrogator itself.

For example, a case is considered in which a conventional article management system is applied, and the interrogator is installed in a cellular phone. With this kind of system, if the cellular phone is misplaced, the article management system itself becomes unable to function. It is to be noted that the frequency at which cellular phones are turned in as things left behind on a train is quite high, and they are said to be one type of article that is easily lost.

In consideration of the foregoing problems, the object of the present invention is to provide a system for prevention of loss of a central management device by wireless communication performed between a central management device and a central response device, where the central management device, which includes a controller, an interrogator, and the like, and the central response device, which is possessed by a user, are provided separately from each other.

One aspect of the present invention is an article management system that has a central response device that is worn by a user and a central management device, incorporated into an article, that can communicate with the central response device wirelessly, where the central management device has an interrogator that communicates wirelessly with the central response device, a detector that detects the communication distance between the interrogator and the central response device, and an alarm portion that notifies the user when the communication distance detected by the detector reaches or exceeds a standard value.

Another aspect of the present invention is an article management system that has a central response device that is worn by a user and a central management device, incorporated into an article, that can communicate with the central response device wirelessly, where the central management device has an interrogator that communicates wirelessly with the central response device, a detector that detects the communication distance between the interrogator and the central response device, an alarm portion that notifies the user when the communication distance detected by the detector reaches or exceeds a standard value, and a controller that controls the central management device.

Another aspect of the present invention is an article management system that has a central response device that is worn by a user; a response device for an article that is incorporated into a first article; and a central management device, incorporated into a second article, that can communicate with the central response device wirelessly; where the central management device has an interrogator that communicates wirelessly with the central response device and with the response device for an article, a detector that detects the communication distance between the interrogator and the central response device as well as the communication distance between the interrogator and the response device for an article, and an alarm portion that notifies the user when the communication distance detected by the detector reaches or exceeds a standard value.

Another aspect of the present invention is an article management system that has a central response device that is worn by a user; a plurality of response devices for articles that are each incorporated into one of a plurality of first articles; and a central management device, incorporated into a second article, that can communicate with the central response device wirelessly, where the central management device has an interrogator that communicates wirelessly with the central response device and with each of the response devices for articles, a detector that detects the communication distance between the interrogator and the central response device as well as the communication distance between the interrogator and each of the response devices for articles, and an alarm portion that notifies the user when the communication distance detected by the detector reaches or exceeds a standard value.

Another aspect of the present invention is an article management system that has a central response device that is worn by a user; a response device for an article that is incorporated into a first article; a central management device, incorporated into a second article, that can communicate with the central response device wirelessly, where the central management device has an interrogator that communicates wirelessly with the central response device and with the response device for an article, a detector that detects the communication distance between the interrogator and the central response device as well as the communication distance between the interrogator and the response device for an article, an alarm portion that notifies the user when the communication distance detected by the detector reaches or exceeds a standard value, and a controller that controls the central management device.

Another aspect of the present invention is an article management system that has a central response device that is worn by a user; a plurality of response devices for articles that are each incorporated into one of a plurality of first articles; and a central management device, incorporated into a second article, that can communicate with the central response device wirelessly, where the central management device has an interrogator that communicates wirelessly with the central response device and with each of the response devices for articles, a detector that detects the communication distance between the interrogator and the central response device as well as the communication distance between the interrogator and each of the response devices for articles, an alarm portion that notifies the user when the communication distance detected by the detector reaches or exceeds a standard value, and a controller that controls the central management device.

The central response device of the present invention may be incorporated into an article that is worn by a person.

Another aspect of the present invention is an article management system that has a central response device incorporated into an article that is worn by a user; a response device for an article that is incorporated into a first article; and a central management device, incorporated into a second article, that can communicate with the central response device wirelessly, where the central management device has an interrogator that communicates wirelessly with the central response device and with the response device for an article, a detector that detects the communication distance between the interrogator and the central response device as well as the communication distance between the interrogator and the response device for an article, and an alarm portion that notifies the user when the communication distance detected by the detector reaches or exceeds a standard value.

Another aspect of the present invention is an article management system that has a central response device incorporated into an article that is worn by a user; a plurality of response devices for articles that are each incorporated into one of a plurality of first articles; and a central management device, incorporated into a second article, that can communicate with the central response device wirelessly, where the central management device has an interrogator that communicates wirelessly with the central response device and with each of the response devices for articles, a detector that detects the communication distance between the interrogator and the central response device as well as the communication distance between the interrogator and each of the response devices for articles, and an alarm portion that notifies the user when the communication distance detected by the detector reaches or exceeds a standard value.

Another aspect of the present invention is an article management system that has a central response device incorporated into an article that is worn by a user; a response device for an article that is incorporated into a first article; and a central management device, incorporated into a second article, that can communicate with the central response device wirelessly, where the central management device has an interrogator that communicates wirelessly with the central response device and with the response device for an article, a detector that detects the communication distance between the interrogator and the central response device as well as the communication distance between the interrogator and the response device for an article, an alarm portion that notifies the user when the communication distance detected by the detector reaches or exceeds a standard value, and a controller that controls the central management device.

Another aspect of the present invention is an article management system that has a central response device incorporated into an article that is worn by a user; a plurality of response devices for articles that are each incorporated into one of a plurality of first articles; a central management device, incorporated into a second article, that can communicate with the central response device wirelessly, where the central management device has an interrogator that communicates wirelessly with the central response device and with each of the response devices for articles, a detector that detects the communication distance between the interrogator and the central response device as well as the communication distance between the interrogator and each of the response devices for articles, an alarm portion that notifies the user when the communication distance detected by the detector reaches or exceeds a standard value, and a controller that controls the central management device.

Another aspect of the present invention is an article management system that has a central response device incorporated into an article that is worn by a user and a central management device, incorporated into an article, that can communicate with the central response device wirelessly, where the central management device has an interrogator that communicates wirelessly with the central response device, a detector that detects the communication distance between the interrogator and the central response device, and an alarm portion that notifies the user when the communication distance detected by the detector reaches or exceeds a standard value.

Another aspect of the present invention is an article management system that has a central response device incorporated into an article that is worn by a user and a central management device, incorporated into an article, that can communicate with the central response device wirelessly, where the central management device has an interrogator that communicates wirelessly with the central response device, a detector that detects the communication distance between the interrogator and the central response device, an alarm portion that notifies the user when the communication distance detected by the detector reaches or exceeds a standard value, and a controller that controls the central management device.

In the structures of the present invention described above, it is preferable that the central response device and the response device for an article be semiconductor devices.

In the structures of the present invention described above, it is preferable that the central response device and the response device for an article each have a battery that can be charged up wirelessly.

In the structures of the present invention described above, the article that is worn by the user may have a conductive material, and the conductive material may function as an antenna for the central response device.

In the structures of the present invention described above, the article that is worn by the user may be a ring or an earring.

It is to be noted that, in the present specification, "device" generally refers to objects that have a means used to accomplish some particular objective. Furthermore, a device may be a stand-alone object or a plurality of devices integrated together into one device. A plurality of devices may be incorporated in one device, as well.

It is to be noted that, in the present specification, as a general rule, "worn by" or "equipped with" refers to attachment of an object or objects to a human body or an article in such a way that the object or objects cannot be separated or unfastened from the body or article. Furthermore, this situation is not limited to cases of attachment to the exterior of a human body or an article but also includes cases of implantation into a human body and installation into the interior of an article.

It is to be noted that, in the present specification, not only does the controller perform control of each device but it also includes memory functions, arithmetic functions, and the like that are required for controlling.

It is to be noted that, in the present specification, "to be connected" is used synonymously with "to be electrically connected." Consequently, in the structure described in the present specification, in addition to a given connection relationship, other elements (for example, a switch, a transistor, a capacitive element, an inductor, a resistive element, a diode, or the like) that can be electrically connected between the objects in the given connection relationship may be placed therebetween, as well.

In the present invention, because the central response device that is worn by a human being (a user) and the central management device that has the controller and interrogator are each provided separately, loss of the central management device, which has the controller, which is used to control the article management system, and the interrogator, itself can be prevented.

By the present invention, the article management system can be made to function more assuredly without any loss of the central management device. For this reason, management of articles can be carried out more easily and more efficiently. Consequently, loss of articles can be prevented, and financial losses for the user can be prevented, as well. Furthermore, damage resulting from crime such as theft or the like can be prevented or reduced, as well.

Moreover, loss of the central response device can be prevented and the reliability of the article management system can be improved by the central response device being incorporated into an object that is not often removed and the object that is not often removed being worn by a human being (a user).

BEST MODE FOR CARRYING OUT THE INVENTION

Hereinafter, embodiment modes and an embodiment of the present invention will be described with reference to drawings. However, the present invention can be implemented in a lot of different modes, and it is to be easily understood by those skilled in the art that various changes and modifications can be made without any departure from the spirit and scope of the present invention. Accordingly, the present invention is not to be taken as being limited to the described content of the embodiment modes and embodiment included herein.

(Embodiment Mode 1)

One aspect of an article management system to which the present invention is applied will be described with reference to drawings.

Figure 1:
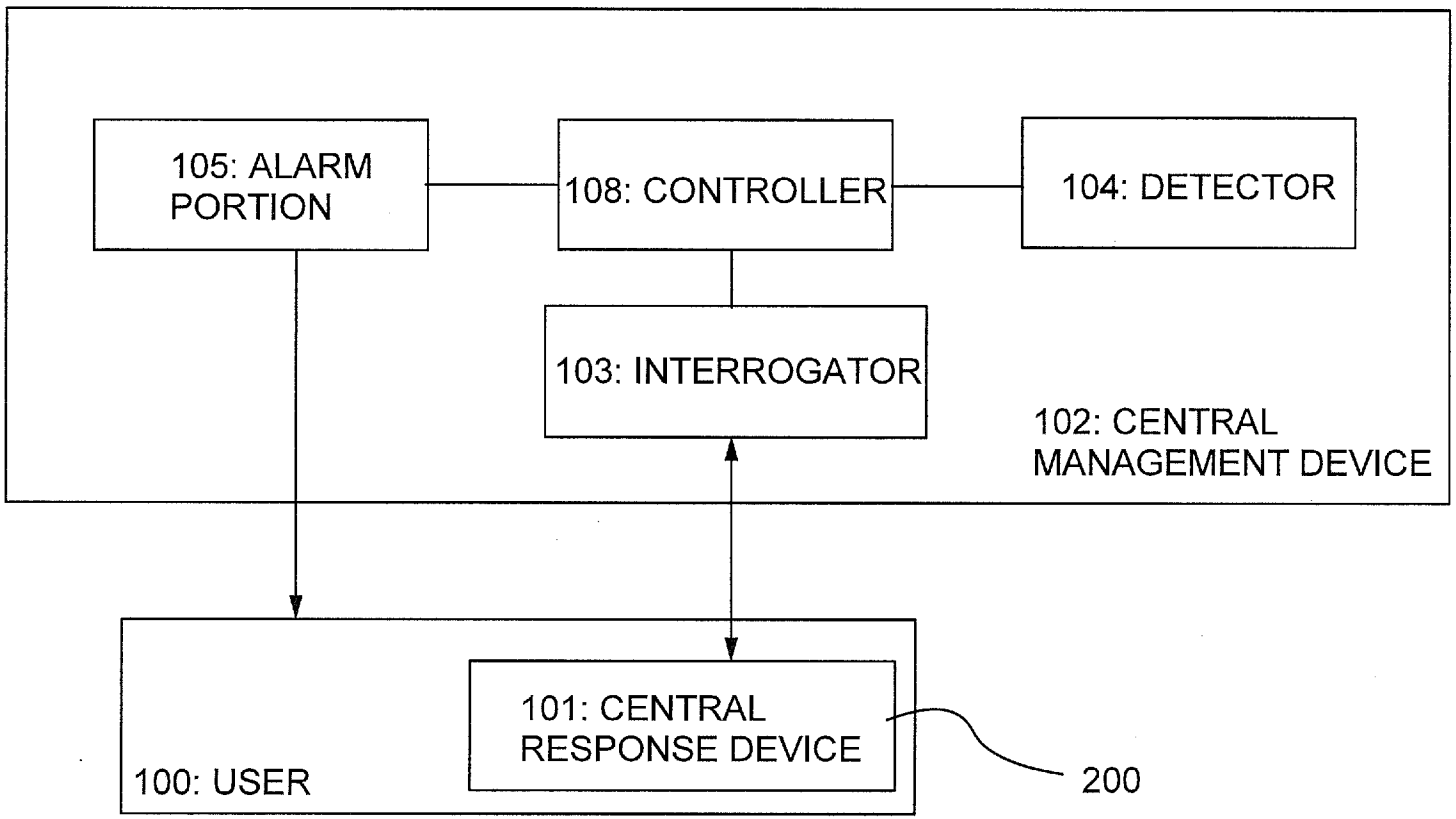
FIG. 1 is a diagram used to describe one aspect of the present invention.

In FIG. 1, a block diagram used to describe a structure of an article management system of the present embodiment mode is shown. The article management system of the present embodiment mode has a central management device and a response device. The central management device has an interrogator, a detector, an alarm portion, and a controller. The response device has at least one central response device.

A user 100 is equipped with a central response device 101 and manages a central management device 102. The central response device 101 is provided separately from the central management device 102.

It is to be noted that the central response device 101 may be implanted directly into the user 100 or indirectly attached. Here, "indirectly attached" refers to a case in which the central response device 101 is attached to an object that is to be worn by the user 100, the object that is to be worn by the user 100 is worn by the user 100, and accordingly, the central response device 101 is, in effect, attached to the user 100. By selection of an object that is not often removed for the article that is to be worn by the user, loss of the central response device can be prevented, and the reliability of the article management system can be improved.

The central response device 101 and an interrogator 103 communicate with each other wirelessly. Wireless communication may be performed such that signals are transmitted and received during a randomly determined period, or it may be performed such that signals are transmitted and received continuously. The interrogator 103, a detector 104, and an alarm portion 105 are connected to a controller 108, and wired or wireless communication is performed. When the interrogator 103, the detector 104, and the alarm portion 105 are incorporated into the central management device and the central management device is made from one case, setting communication to wired communication is preferable.

Figure 19:
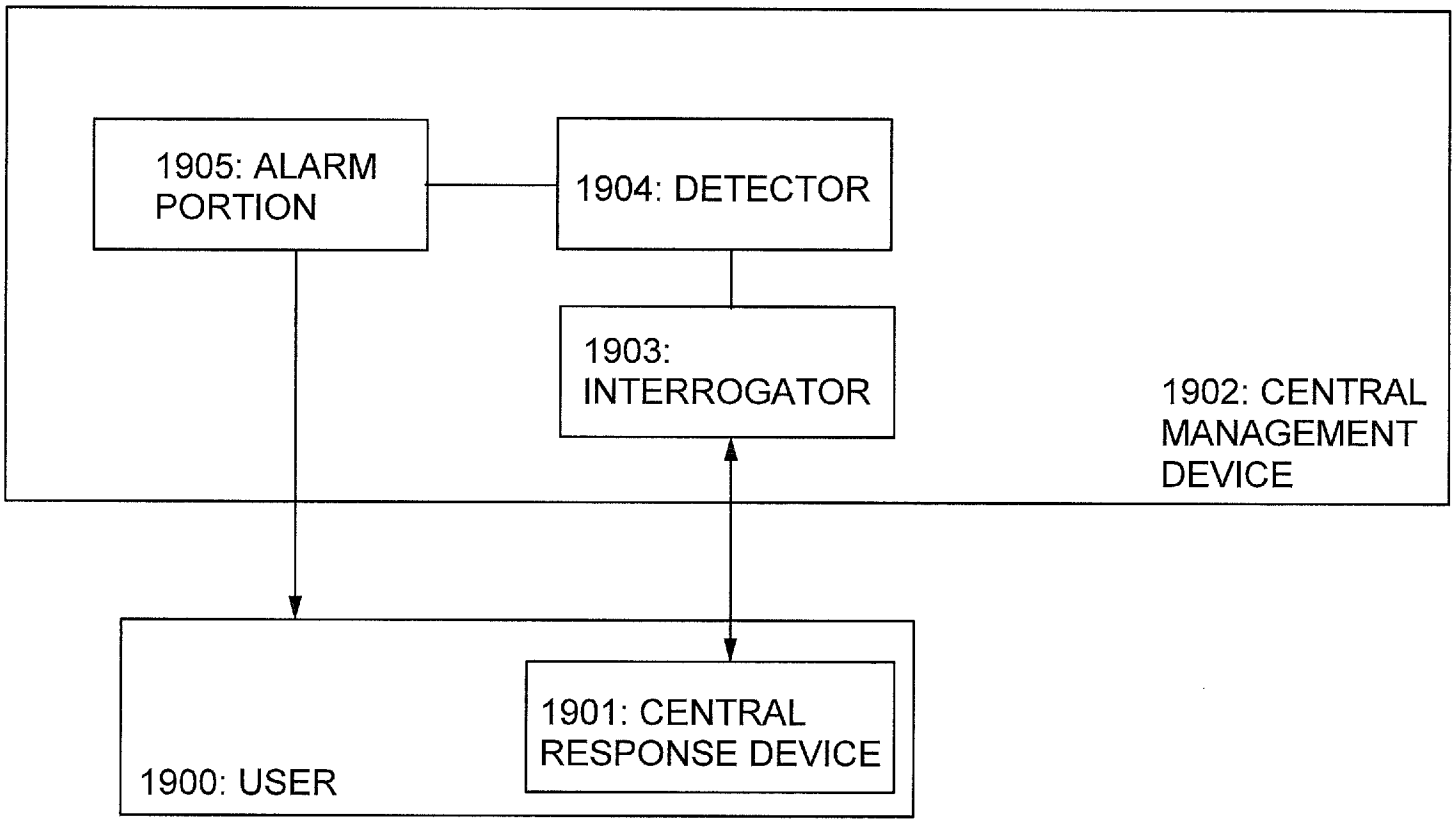
FIG. 19 is a diagram used to describe one aspect of the present invention.

It is to be noted that, as shown in FIG. 19, the central management device need not have a controller if there is no need for one. For this case, the central management device of the article management system has an interrogator, a detector, and an alarm portion. The response device has at least one central response device. An interrogator 1903, a detector 1904, and an alarm portion 1905 in FIG. 19 correspond to the interrogator 103, the detector 104, and the alarm portion 105, respectively.

A user 1900 is equipped with a central response device 1901 and manages a central management device 1902. The central response device 1901 is provided separately from the central management device 1902.

It is to be noted that the central response device 1901 may be attached to the user 1900 directly or attached indirectly. Here, "attached indirectly" refers to a case in which the central response device 1901 is attached to an object that is to be worn by the user 1900, the object that is to be worn by the user 1900 is worn by the user 1900, and accordingly, the central response device 1901 is, in effect, attached to the user 1900. By selection of an object that is not often removed for the article that is to be worn by the user, loss of the central response device can be prevented, and the reliability of the article management system can be improved.

The central response device 1901 and the interrogator 1903 communicate with each other wirelessly. Wireless communication may be performed such that signals are transmitted and received during a randomly determined period, or it may be performed such that signals are transmitted and received continuously. The interrogator 1903 is connected to the detector 1904, the detector 1904 is connected to the alarm portion 1905, and these perform wired or wireless communication. When the interrogator 1903, the detector 1904, and the alarm portion 1905 are incorporated into the central management device and the central management device is made from one case, setting communication to wired communication is preferable.

Figure 2:
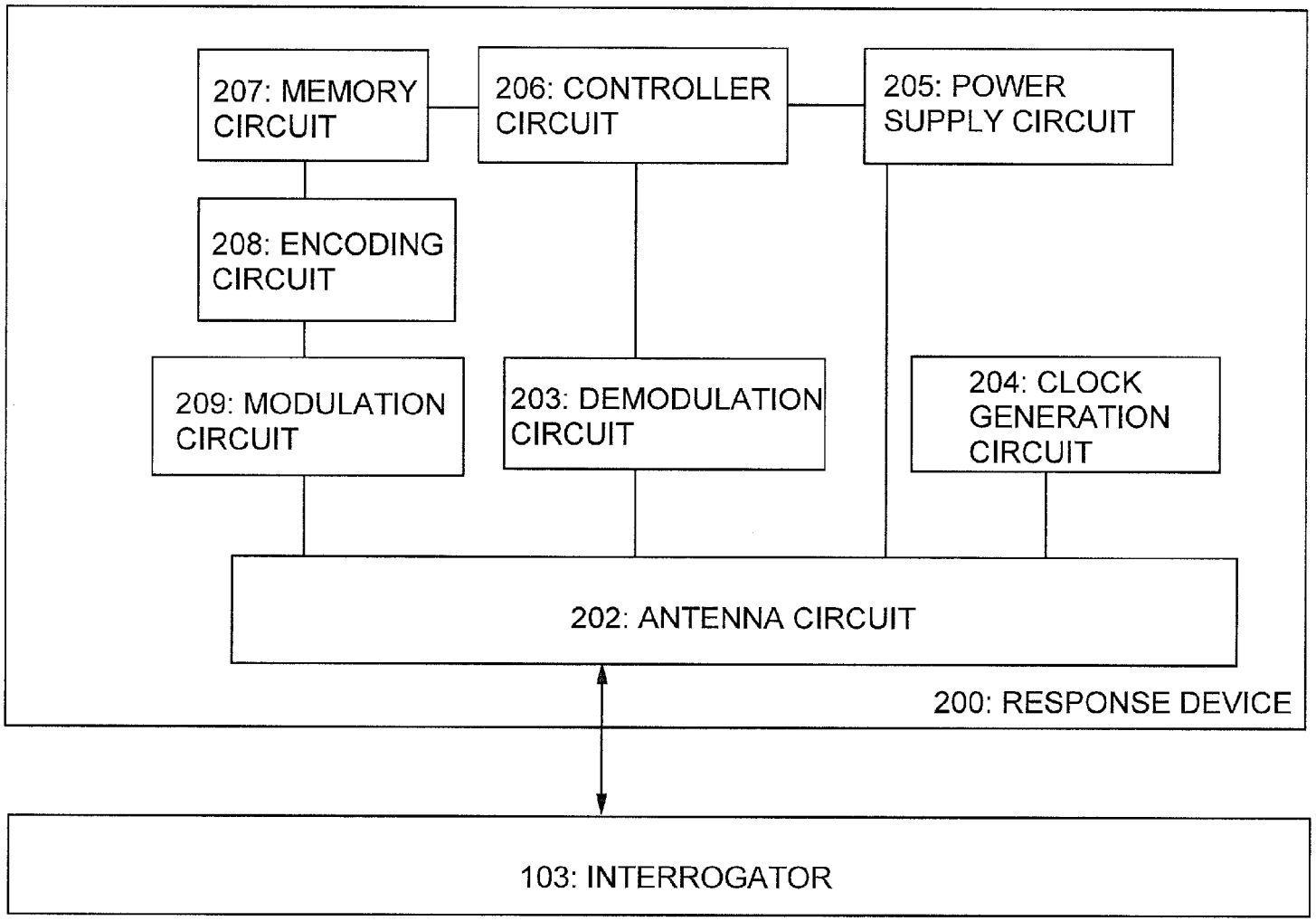
FIG. 2 is a diagram used to describe one aspect of a response device used in the present invention.

An example of the structure of a response device 200, represented by the central response device 101 of the present embodiment mode, is shown in FIG. 2. The response device 200 has an antenna circuit 202, a demodulation circuit 203, a clock generation circuit 204, a power supply circuit 205, a controller circuit 206, a memory circuit 207, an encoding circuit 208, and a modulation circuit 209.

The antenna circuit 202 transforms carrier waves supplied from the interrogator 103 into alternating current electric signals. It is preferable that the antenna circuit 202 have a rectifier circuit.

It is to be noted that there are no limitations, in particular, on the shape of the antenna that can be used in the present invention. For this reason, an electromagnetic coupling method, an electromagnetic induction method, an electromagnetic wave method, an optical method, or the like can be used as a signal transmission method applied to the antenna circuit 202 in the response device 200. Preferably, an electromagnetic coupling method, an electromagnetic induction method, or an electromagnetic wave method is used. The implementer should select the transmission method, as appropriate, in consideration of the intended use, and an antenna with the most appropriate length and shape for the transmission method selected should be provided. An electromagnetic wave method can be used for the signal transmission method in the present invention, and further, a microwave method can be used, as well.

When an electromagnetic coupling method or electromagnetic induction method (for example, in the 13.56 MHz band) is applied for the transmission method, because electromagnetic induction by change in electric field density is used, the conductive film that functions as an antenna is formed into a ring shape (for example, as a loop antenna) or a spiral shape (for example, as a spiral antenna).

When a microwave method (for example, in the UHF band (the 860 MHz to 960 MHz band), the 2.45 GHz band, or the like), which is one type of electromagnetic wave method, is applied for the transmission method, the most appropriate length and shape of a conductive film that functions as an antenna should be selected in consideration of the wavelength of the electromagnetic waves used for the transmission of signals. For example, the conductive film that functions as an antenna can be formed into a linear shape (for example, as a dipole antenna), a planar shape (for example, as a patch antenna), or the like. Furthermore, the shape of the conductive film that functions as an antenna is not limited to being a linear shape but may be a curved shape, a serpentine shape, or a combination of any of these, in consideration of the wavelength of the electromagnetic waves used.

Figure 12A:
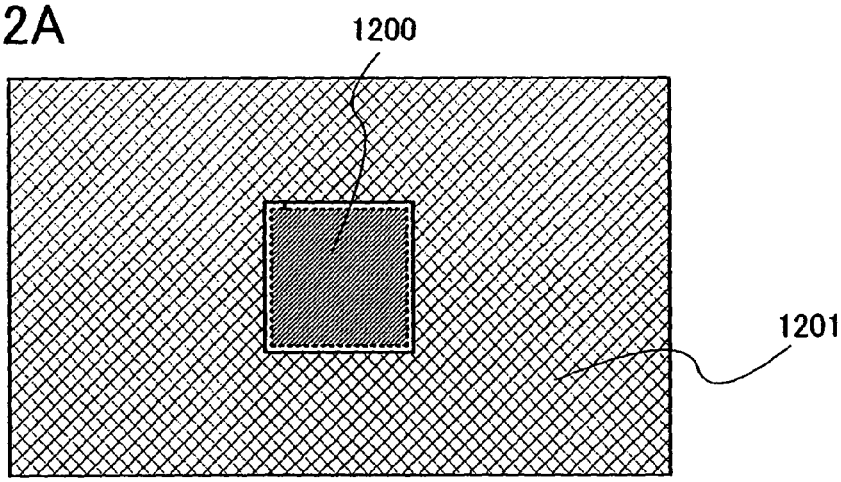
FIGS. 12A to 12E are diagrams used to describe one aspect of an antenna of a response device used in the present invention.
Figure 12B:
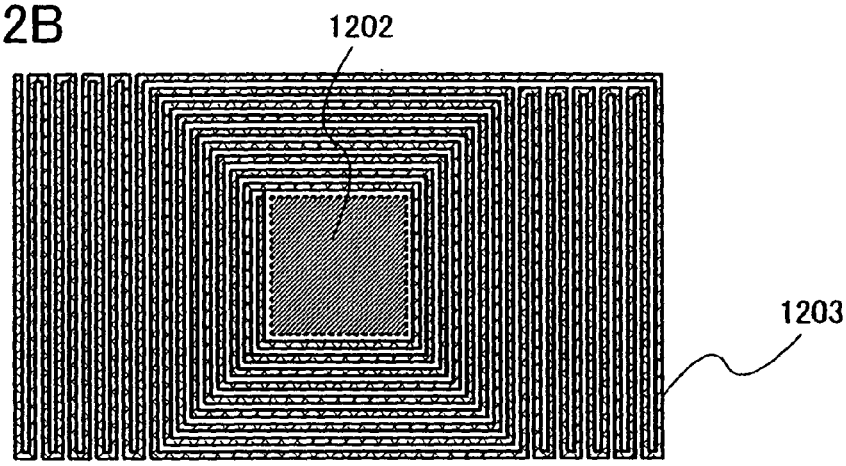
Figure 12C:
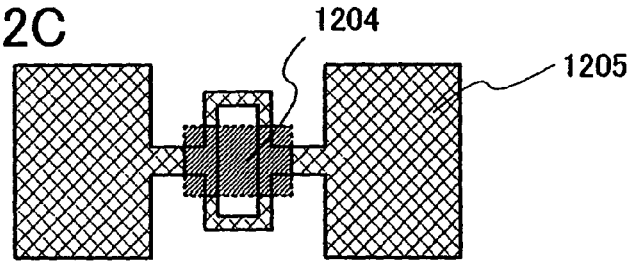
Figure 12D:
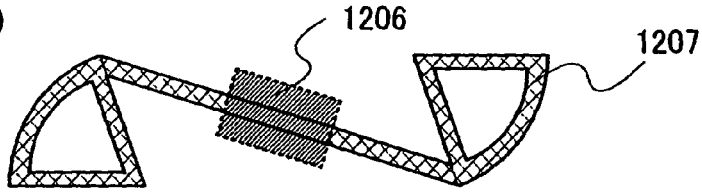
Figure 12E:
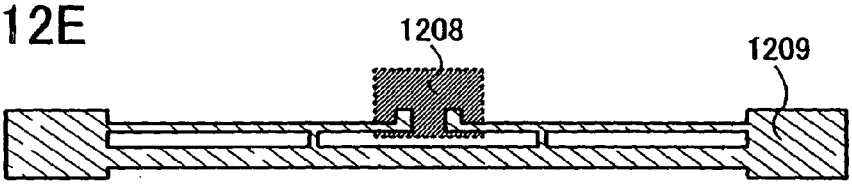

Here, some examples of the shape of an antenna provided in the antenna circuit 202 are shown in FIGS. 12A to 12E. For example, the structure may be set as one in which, as shown in FIG. 12A, one surface of an antenna 1201 is arranged all around a chip 1200 that is provided in a signal processing circuit. Alternatively, the structure may be set as one in which, as shown in FIG. 12B, a thin antenna 1203 is arranged all around a chip 1202 that is provided in a signal processing circuit in such a way that the antenna 1203 winds around the perimeter of the chip 1202. Furthermore, the shape of an antenna may be arranged like that of an antenna 1205, which is used to receive high-frequency electromagnetic waves, with respect to a chip 1204 that is provided in a signal processing circuit as shown in FIG. 12C. Moreover, the shape of an antenna may be arranged like that of an antenna 1207, which is omnidirectional (can receive signals from any direction) in 180°, with respect to a chip 1206 that is provided in a signal processing circuit, as shown in FIG. 12D. In addition, as shown in FIG. 12E, the shape of an antenna may be arranged like that of an antenna 1209, which extends out in a rod-shape, with respect to a chip 1208 that is provided in a signal processing circuit. For the antenna circuit 202, an antenna of one of these shapes or a combination of any of these shapes can be used.

Furthermore, as shown in FIGS. 12A to 12E, there are no limitations, in particular, on the method for connection of the chip 1200, and the like, provided in a signal processing circuit and the antenna 1201 and the like. If FIG. 12A is given as an example, the antenna 1201 and the chip 1200 that is provided in a signal processing circuit may be connected to each other by a wire bonding connection or a solder bump connection or by a method in which a part of the chip 1200 is attached to the antenna 1201 as an electrode. With this method, the chip 1200 can be attached to the antenna 1201 using an anisotropic conductive film (ACF). In addition, the required length of the antenna differs depending on the frequency of the received signals. For example, if the frequency is 2.45 GHz, the length should be about 60 mm (half of the wavelength) if a half-wavelength dipole antenna is provided for the antenna and about 30 mm (one-fourth of the wavelength) if a monopole antenna is provided for the antenna. When the frequency is 900 MHz, which is particularly preferable, data is transmitted and received by an electromagnetic wave method using an antenna with a length greater than or equal to 100 mm and less than or equal to 150 mm.

The demodulation circuit 203 demodulates the alternating current electrical signal that is converted by the antenna circuit 202 and transmits the demodulated signal to the control circuit 206. It is to be noted that the demodulation circuit 203 need not be provided if there is no particular need for it.

The clock generation circuit 204 supplies a clock signal needed for operation to the control circuit 206, the memory circuit 207, and the encoding circuit 208. For examples of the structure of the circuit, the structure may be set to be that of an oscillation circuit or a frequency divider circuit.

The power supply circuit 205 generates a power supply voltage using alternating current electrical signals converted by the antenna 202 and supplies a power supply voltage needed for operation to each circuit.

The control circuit 206 performs analysis of commands and control of the memory circuit 207 based on signals demodulated by the demodulation circuit 203 and performs output and the like to the modulation circuit 209 of data to be transmitted to external.

The memory circuit 207 should be a kind of memory that can store information that the response device 200 should have. The memory circuit 207 has a circuit with a memory element and a control circuit that writes and reads out data based on the control circuit 206. At the very least, individualized identification information (ID) about the response device 200 itself is stored in the memory circuit 207. The individualized identification information (ID) is used to differentiate among response devices (among different response devices that are worn by the user as well as response devices that are worn by people other than the user). In addition, the memory circuit 207 has one or a plurality of kinds of memory selected from organic memory, dynamic random access memory (DRAM), static random access memory (SRAM), ferroelectric random access memory (FeRAM), mask read only memory (mask ROM), programmable read only memory (PROM), electrically programmable read only memory (EPROM), electrically erasable programmable read only memory (EEPROM), and flash memory. If the content of the memory is to be specific information (individualized identification information (ID) or the like) about the response device 200, non-volatile memory, which can retain what is stored in memory even if no power supply is, supplied, should be used; if the content of the memory is to be temporarily retained whenever the response device 200 performs data processing, volatile memory may be used. In particular, when the response device 200 is a passive type, which does not have a battery, using non-volatile memory is preferable.

Because organic memory has a simple structure in which a layer that contains an organic compound is interposed between a pair of conductive layers, there are at least two advantages to using organic memory. One advantage is that the manufacturing process can be simplified and costs can be reduced. Another advantage is that the area of a stack of layers can easily be made smaller and mass-production can easily be realized. Because of these advantages, using organic memory in the memory circuit 207 is preferable.

The encoding circuit 208, transforms all or a part of the data that is extracted from the memory circuit 207 and data that is transmitted to the interrogator 103 from the response device 200 into an encoded signal. It is to be noted that the encoding circuit 208 need not be provided if there is no particular need for it.

The modulation circuit 209 adds load modulation to the antenna circuit 202 based on signals encoded by the encoding circuit 208.

Figure 3:
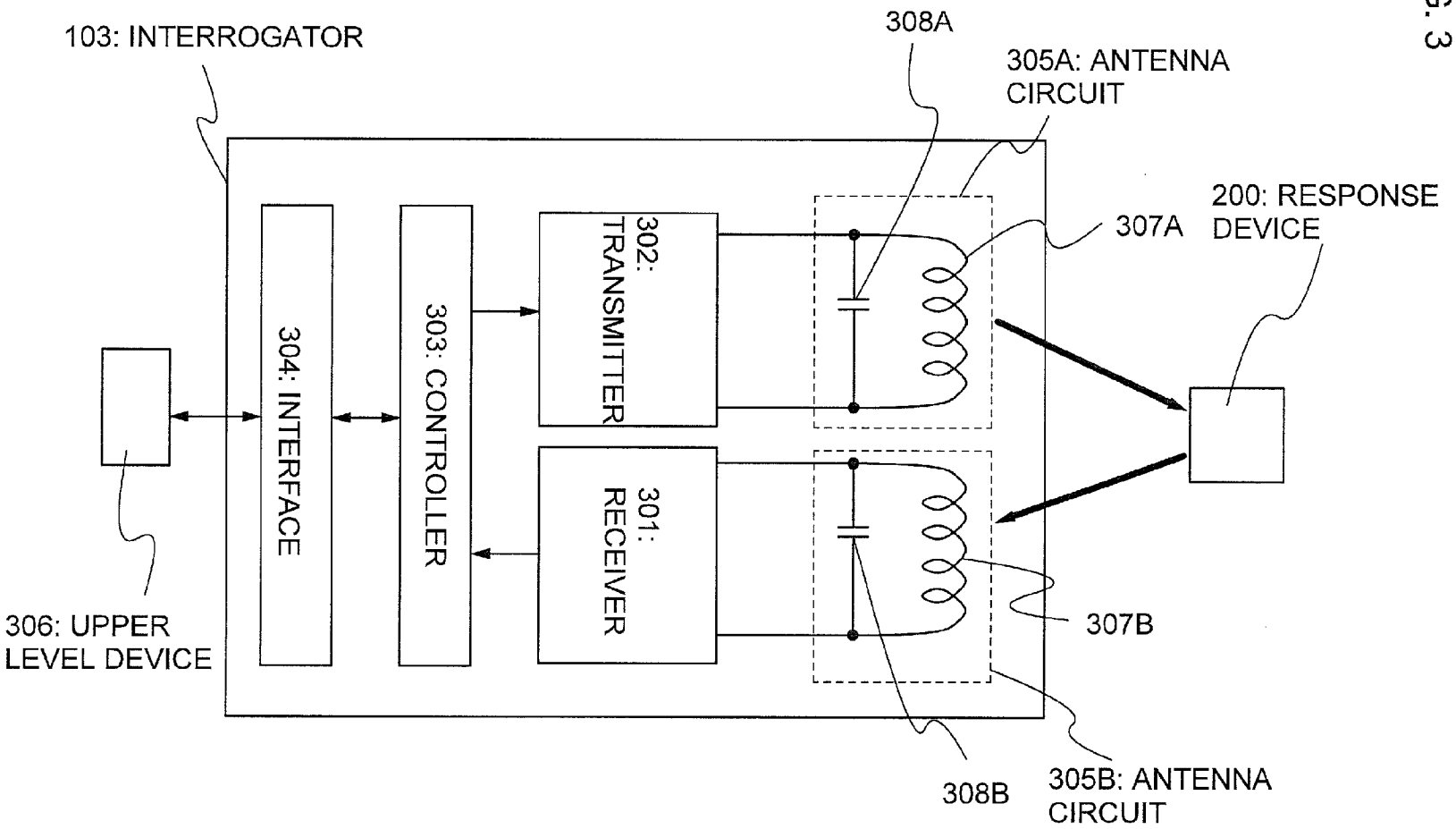
FIG. 3 is a diagram used to describe one aspect of an interrogator used in the present invention.

The interrogator 103 communicates with the response device 200 wirelessly. The interrogator 103 is also referred to as a reader/writer. An example of the interrogator 103 will be described using FIG. 3. The interrogator 103 has a receiver 301, a transmitter 302, a controller 303, an interface 304, and an antenna circuit (an antenna circuit 305A and an antenna circuit 305B). The antenna circuit (the antenna circuit 305A and the antenna circuit 305B) has an antenna (an antenna 307A and an antenna 307B) and a resonant capacitor (a resonant capacitor 308A and a resonant capacitor 308B). The antenna (the antenna 307A and the antenna 307B) and the resonant capacitor (the resonant capacitor 308A and the resonant capacitor 308B) make up an LC parallel resonant circuit.

The controller 303 controls the receiver 301 and the transmitter 302 based on data processing commands and data processing results from an upper-level device 306 via the interface 304. The transmitter 302 modulates data processing commands transmitted to the response device 200 and outputs the results from the antenna circuit 305A as electromagnetic waves. The receiver 301 demodulates signals received by the antenna circuit 305B and outputs the data to the controller 303 as data processing results. When wireless signals are received, the antenna circuit 305B receives an electromagnetic force that is induced in the antenna circuit 305B by signals output from the response device 200 as electrical signals. In addition, when signals are transmitted, an induced electric current is supplied to the antenna circuit 305A, and signals are transmitted to the response device 200 by the antenna circuit 305A.

The detector 104 detects the state of communication between the interrogator 103 and the response device 200. The detector 104 may be a device that detects the presence of communication signals between the interrogator 103 and the response device 200 or it may be a device that detects the communication distance between the interrogator 103 and the response device 200.

For the detector 104, an analog comparator, for example, can be used. An analog comparator is an operational amplifier that has two inputs, where the structure is one in which one of the inputs is set to be a reference voltage $V_{ref}$, a voltage ($V_{in}$) that is input from an input voltage of the other input is compared to the reference voltage $V_{ref}$, and the results of that comparison are output as one of two values, either as a high voltage or as a low voltage.

Figure 4A:
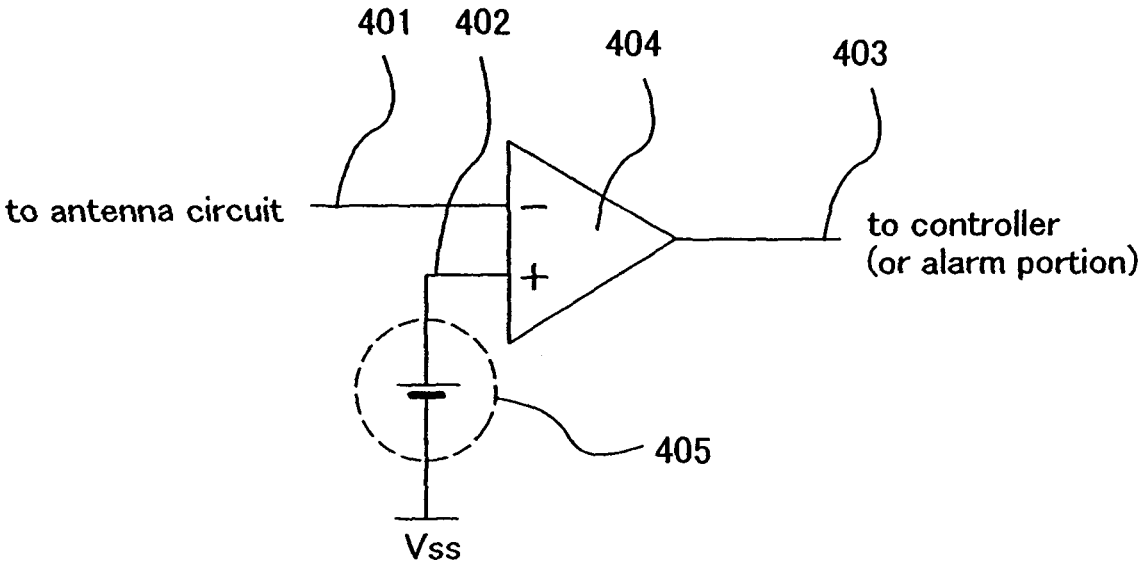
FIGS. 4A and 4B are diagrams used to describe one aspect of a detector used in the present invention.
Figure 4B:
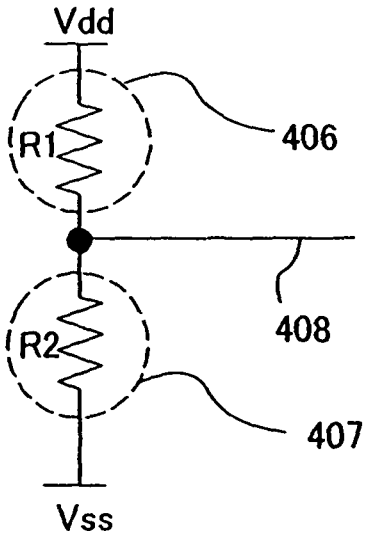

An example of the most minimized circuit structure of an analog comparator used in the detector 104 is shown in FIG. 4. The analog comparator of FIG. 4A has a first input 401, a second input 402, an output 403, an operational amplifier 404, and a reference voltage power supply 405. The reference voltage power supply 405 is connected to the second input 402 and a standard electric potential $V_{ss}$. The first input 401 is connected to an antenna circuit via a rectifier circuit.

When the voltage ($V_{in}$) of the first input 401 is high compared to the reference voltage ($V_{ref}$), the voltage ($V_{out}$) of the output 403 goes low. On the other hand, when the voltage ($V_{in}$) of the first input 401 is low compared to the reference voltage ($V_{ref}$), the voltage ($V_{out}$) of the output 403 goes high.

When the voltage ($V_{in}$) of the signal received by an antenna circuit (for example, the antenna circuit 305B) is higher than the reference voltage ($V_{ref}$), the voltage ($V_{out}$) of the output 403 drops. When the voltage ($V_{in}$) of the signal received by the antenna circuit 305B is lower than the reference voltage ($V_{ref}$), the voltage ($V_{out}$) of the output 403 rises. Consequently, if the communication distance between the response device 200 and the interrogator 103 increases, the voltage, of the output 403 rises. As a result, when the voltage of the output 403 is high, the structure may be set to be one in which the information is communicated to the controller 108 and the controller 108 makes the alarm portion 105 operate. The input voltage being low means that the strength of signals received is getting weaker, that is, that there is a wide distance between the interrogator and the response device.

It is to be noted that the circuit symbol for a power supply is used for the reference voltage power supply 405 in FIG. 4A; however, the structure of the present invention is not limited to this. For example, a bias circuit shown in FIG. 4B may be used, as well. The bias circuit of FIG. 4B has a first resistor 406 (with resistance of $R_1$), a second resistor 407 (with resistance of $R_2$), and an output 408. One terminal of the first resistor 406 is connected to a power supply electric potential, and the other terminal of the first resistor 406 is connected to one terminal of the second resistor 407 and to the output 408. The other terminal of the second resistor 407 is connected to a standard electric potential. By adjustment of the resistance $R_1$ of the first resistor 406 and the resistance $R_2$ of the second resistor 407, the voltage of the output 408 can be regulated to be a given amount of voltage. The voltage of the output 408 comes to be the reference voltage $V_{ref}$. By the detector being set to have the structure shown in FIGS. 4A and 4B, not only does the detector 104 become able to detect the presence of signals communicated between the interrogator 103 and the response device 200, but it also becomes able to detect the communication distance, as well. By detection of communication distance, a given distance can be set to be a reference value as necessary, and the present invention can be used even more effectively. It is to be noted that the reference voltage may be set according to the upper limit of the communication distance.

The alarm portion 105 processes information used to communicate information by a means that can be perceived by the user 100. Because the user 100 is a human being, a means that can be perceived through a human being's five senses can be given for the means that can be perceived by the user 100. For these kinds of means, for example, emission of sound, vibration, and the like can be given. The user 100 can perceive the information through the sense of hearing if the alarm portion 105 emits a sound. In addition, the user 100 can perceive the information through the sense of touch if the alarm portion 105 vibrates.

Figure 5A:
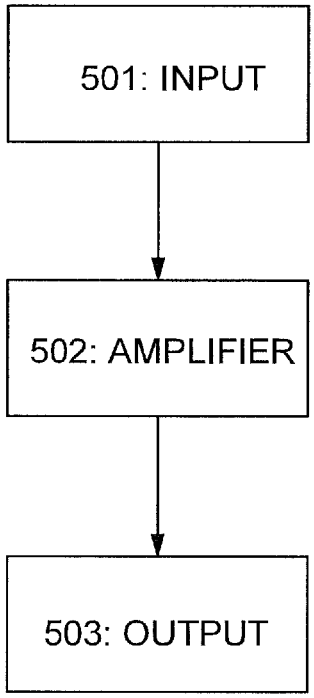
FIGS. 5A and 5B are diagrams used to describe one aspect of an alarm portion used in the present invention.

An example of a structure for a case when information is communicated by the alarm portion 105 emitting a sound is shown in FIG. 5A. The alarm portion 105 has an input 501, an amplifier 502, and an output 503. Commands output from the controller 108 and information output from the detector 104 directly (information that does not come through the controller 108) are input to the input 501. Signals input to the input 501 are communicated to the amplifier 502. The amplifier 502 boosts the voltage so that a sound with enough volume to be perceived by the user 100 is produced. The boosted signal is communicated to the output 503, and the output 503 emits a sound. It is to be noted that the amplifier 502 need not be provided if there is no particular need for it.

Figure 5B:
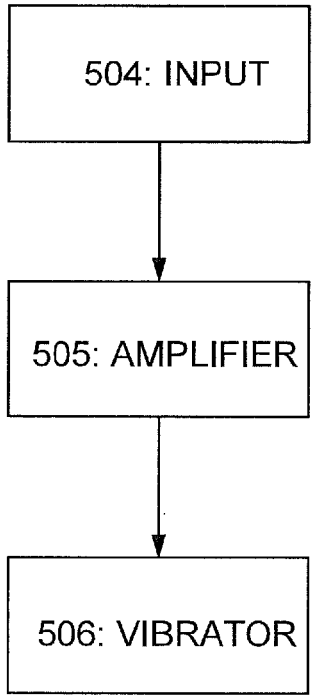

An example of a structure for a case when information is communicated by the alarm portion 105 vibrating is shown in FIG. 5B. The alarm portion 105 has an input 504, an amplifier 505, and a vibrator 506. Commands output from the controller 108 and information output from the detector 104 directly (information that does not come through the controller 108) are input to the input 504. Signals input to the input 504 are communicated to the amplifier 505. The amplifier 505 boosts the voltage so that a vibration great enough to be perceived by the user 100 is produced. The boosted signal is communicated to the vibrator 506, and the vibrator 506 vibrates. It is to be noted that the amplifier 505 need not be provided if there is no particular need for it.

It is to be noted that, in the present invention, although a structure in which the detector 104 and the alarm portion 105 are provided in the central management device 102 only is described, the detector 104 and the alarm portion 105 may be provided in the central response device 101, as well. When the detector 104 is provided in the central response device 101, the structure may be set to be one in which the detector 104 is connected via a rectifier circuit provided in the antenna circuit 202 of the central response device 101 and information produced whenever an aberration is detected by the detector 104 can be communicated to the control circuit 206. When the alarm portion 105 is provided in the central response device 101, the structure may be set to be one in which information produced whenever an aberration is detected can be communicated to the control circuit 206 and the alarm portion 105 can notify the user 100 of the aberration.

When the central response device 101 equipped with the alarm portion 105 is directly implanted into a user or inserted into an object that is to be worn and the object that is to be worn into which the alarm portion 105 is inserted comes into contact with a user, a method by weak electric current can be used as the means by which the alarm portion 105 communicates information. The amount of current for the weak electric current is set to be an amount great enough to be perceived by a human being but within a range that does not affect the human body. In order to set this kind of range, both the amount of electric current and the amount of voltage need to be considered. In general, the minimum amount of current that can be felt by a human being is 1 mA and above, whereas it is said that the muscles contract and become unable to be moved if a current of 20 mA or more flows through the body. Therefore, the amount of current for the weak electric current should be set to be greater than or equal to 1 mA and less than 20 mA. For voltage, it is said that an amount of voltage of 10 V or greater has an effect on the human body; therefore, the amount of voltage should be set to be less than 10 V. Furthermore, although it does not pose a problem if the electric current flowing through the human body is a direct current electric current, there is a need for caution with regard to frequency, as well, when the current is an alternating current electric current. When an alternating current electric current flows through the human body, it is said that frequencies greater than or equal to 40 Hz and less than or equal to 150 Hz cause the most damage and have the greatest effect but that high frequencies (greater than or equal to 50,000 Hz) have little effect. For this reason, whenever an alternating current electric current is used for the weak electric current, it is preferable that the frequency band from 40 Hz to 150 Hz be avoided and the frequency be set to be as high as possible.

Here, operations of the article management system of the present invention shown in FIG. 1 will be described with reference to FIG. 6B.

First, the interrogator 103 transmits signals by carrier waves. The transmitted signals are received by the response device 200. Here, only the central response device 101 is considered for the response device 200. It is to be noted that unique individualized identification information (ID) for the central management device 102, at least, is given in order to identify that the response device in the signal is the central response device 101 of the user 100. When the transmitted signal is received by the central response device 101 via the antenna circuit 202, the signal is demodulated by the demodulation circuit 203 and input to the control circuit 206. By commands of the input signals, the individualized identification information (ID) for the central response device 101 is read from the memory circuit 207 and transmitted to the encoding circuit 208. The signal transmitted to the encoding circuit 208 is modulated by the modulation circuit 209 and transmitted to the interrogator 103 from the antenna circuit 202. The interrogator 103 transmits the received information to the upper-level device 306 and verifies that the individualized identification information (ID) is normal. The upper-level device 306 corresponds to the controller 108.

If the transmitted signal is not received by the central response device 101, the interrogator 103 does not receive any carrier waves because the central response device 101 does not transmit any signal. As a result, the detector 104 connected to the antenna 305A or the antenna 305B of the interrogator 103 operates and sends information to the controller 108. The controller 108 transmits commands to the alarm portion 105 in accordance with that information and makes the alarm portion 105 operate. The alarm portion communicates information by the means that can be perceived by the user 100 based on the commands from the controller 108. It is to be noted that the commands from the detector 104 may be communicated to the alarm portion 105 without being sent via the controller 108.

Even if the transmitted signal is received by the central response device 101, the interrogator 103 does not receive any carrier waves in the case of when the central response device 101 does not transmit a signal, either. As a consequence, the detector 104 connected to the antenna 305A or the antenna 305B of the interrogator 103 operates and sends information to the controller 108. The controller 108 transmits commands to the alarm portion 105 in accordance with that information and makes the alarm portion 105 operate. The alarm portion 105 communicates information using the means that can be perceived by the user 100 based on the commands from the controller 108. It is to be noted that the information from the detector 104 may be communicated to the alarm portion 105 without being sent via the controller 108.

It is to be noted that only the central response device is considered in the present embodiment mode. For this reason, the structure may be one in which signals transmitted from the interrogator are communicated to the central response device continuously or one in which signals are transmitted to each response device during a fixed period. For example, a first signal transmitted from the interrogator 103 is a signal that is transmitted to the central response device 101, and therefore, individualized identification information (ID) for the central management device 102 and individualized identification information (ID) for the central response device 101 are given. The central response device 101 possessed by the user 100 receives a first signal from, the interrogator 103. Because the individualized identification information (ID) for the central management device 102 (and the individualized identification information (ID) for the central response device 101) are given in the first signal, this individualized identification information (ID) is compared with individualized identification information (ID) stored in the memory circuit of the relevant response device and sent back when the two match. Here, "sent back" refers to when each circuit of the relevant response device is made to operate according to a signal received from the antenna circuit of the response device and the individualized identification information (ID) stored in the memory circuit of the relevant response device is transmitted from the antenna circuit. At this time, the transmitted signal is not the same as the signal that is transmitted from the interrogator to the response device but is a signal that gives information showing that it is a signal transmitted from the response device to the interrogator. The interrogator that receives the signal transmitted from the response device transmits the relevant information to the controller, and the controller verifies that the relevant response device is present within a normal range.

Figure 6A:
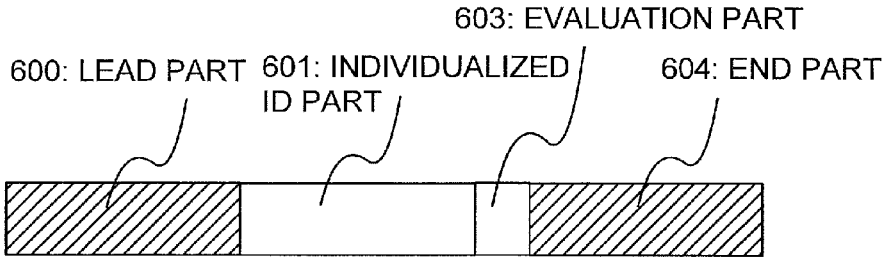
FIGS. 6A and 6B are flowcharts used to describe one aspect of the present invention.

In FIG. 6A, a conceptual diagram of data given in the signals that are transmitted and received is shown. The data of FIG. 6A includes a lead part 600, an individualized identification information (ID) part 601 of a central management device, a data identification evaluation part 603, and an end part 604.

The lead part 600 and the end part 604 each include information needed for transmission and reception of signals, encoding, and decoding. In addition, data needed for encryption may be included as well.

Because the individualized identification information (ID) part 601 of a central management device is used to distinguish one central management device from another central management device, the relevant central management device has unique individualized identification information (ID).

The data identification evaluation part 603 has information that is relevant data that is transmitted to the response device from the interrogator or that is transmitted from the response device to the interrogator.

If transmitted and received data is configured as in the conceptual diagram shown in FIG. 6A, interference between signals can be prevented.

When the individualized identification information (ID) included in the first signal that the response device received does not match the individualized identification information (ID) stored in the memory circuit in the response device, the control circuit of the relevant response device determines that the first signal is not a signal that has been transmitted to the relevant response device and does not operate. Moreover, the control circuit does not operate when the data type of the received signal does not match, either.

When a signal intended for the interrogator 103 is transmitted from the response device and the control circuit determines that transmission and reception of the first signal are performed normally, the interrogator 103 transmits a second signal after a certain period of time has lapsed.

The aforementioned operations will be described with reference to FIG. 6B. First, a process is begun (Step 610). A signal A is transmitted from the interrogator to the central response device (Step 611). When the central response device receives the signal A (Step 612), the central response device performs a given process, and a signal B is transmitted from the central response device to the interrogator (Step 613). If the central response device does not receive the signal A, the detector detects an aberration (Step 615). When the interrogator receives the signal B (Step 614), the operation finishes normally (Step 619). If the interrogator does not receive the signal B, the detector detects an aberration (Step 615).

In the aforementioned operations, when the detector detects an aberration (Step 615), the detector transmits a signal to report to the controller that there is an aberration (Step 616). The controller transmits a command to make the detector operate, based on the relevant information (Step 617). In accordance with the relevant information, the detector communicates information to the user (Step 618) so that the user is informed of the aberration. Then, the process finishes (Step 619).

Figure 6B:
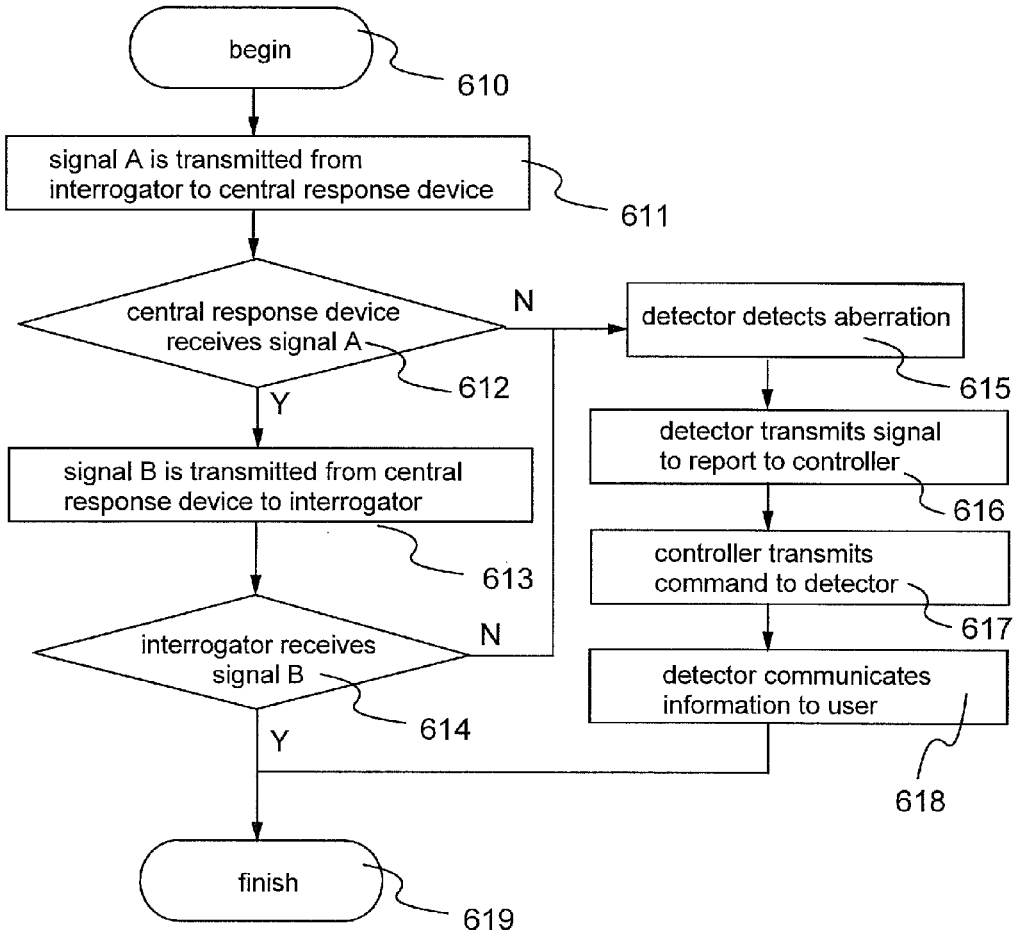

FIG. 6B shows the one flow of the process; however, if another process is started after one finishes, the operations can be performed continuously.

As described above, when a signal from the interrogator is not received by the response device or when a signal from the response device is not received by the interrogator, the detector operates and makes the alarm portion operate. By operation of the alarm portion, the user recognizes that there is an aberration in communication between the response device and the interrogator. When the user recognizes that there is an aberration, he or she may respond by searching for the response device or doing the like.

It is to be noted that the interrogator 103, the detector 104, and the alarm portion 105 provided in the central management device 102 may each have a separate power supply or they may share a common power supply that is provided in the central management device 102. When the interrogator 103, the detector 104, and the alarm portion 105 of the central management device 102 are provided in one case, it is preferable that they share a common power supply.

It is to be noted that, in the present embodiment mode, a case where the person (hereinafter referred to as a perceiver) who perceives information that is provided by the alarm portion 105 and the user were the same person was described; however, the user and the perceiver need not be the same person.

It is to be noted that, in the present embodiment mode, a structure in which the central management device 102 has the controller 108 is described; however, if each device has a control circuit or the like that has the same function as that of the controller 108, the controller 108 need not necessarily be provided.

It is to be noted that when the central management device 102 is incorporated as part of another electronic device, the interrogator 103, the detector 104, and the alarm portion 105 provided in the central management device 102 may be substituted for with other devices that have the same functions. For example, when the central management device is incorporated into a cellular telephone, a device in the cellular telephone that produces a sound when a phone call is received may be used instead of the alarm portion.

Here, a case where the central management device is incorporated into a cellular phone will be described with reference to drawings.

Figure 21:
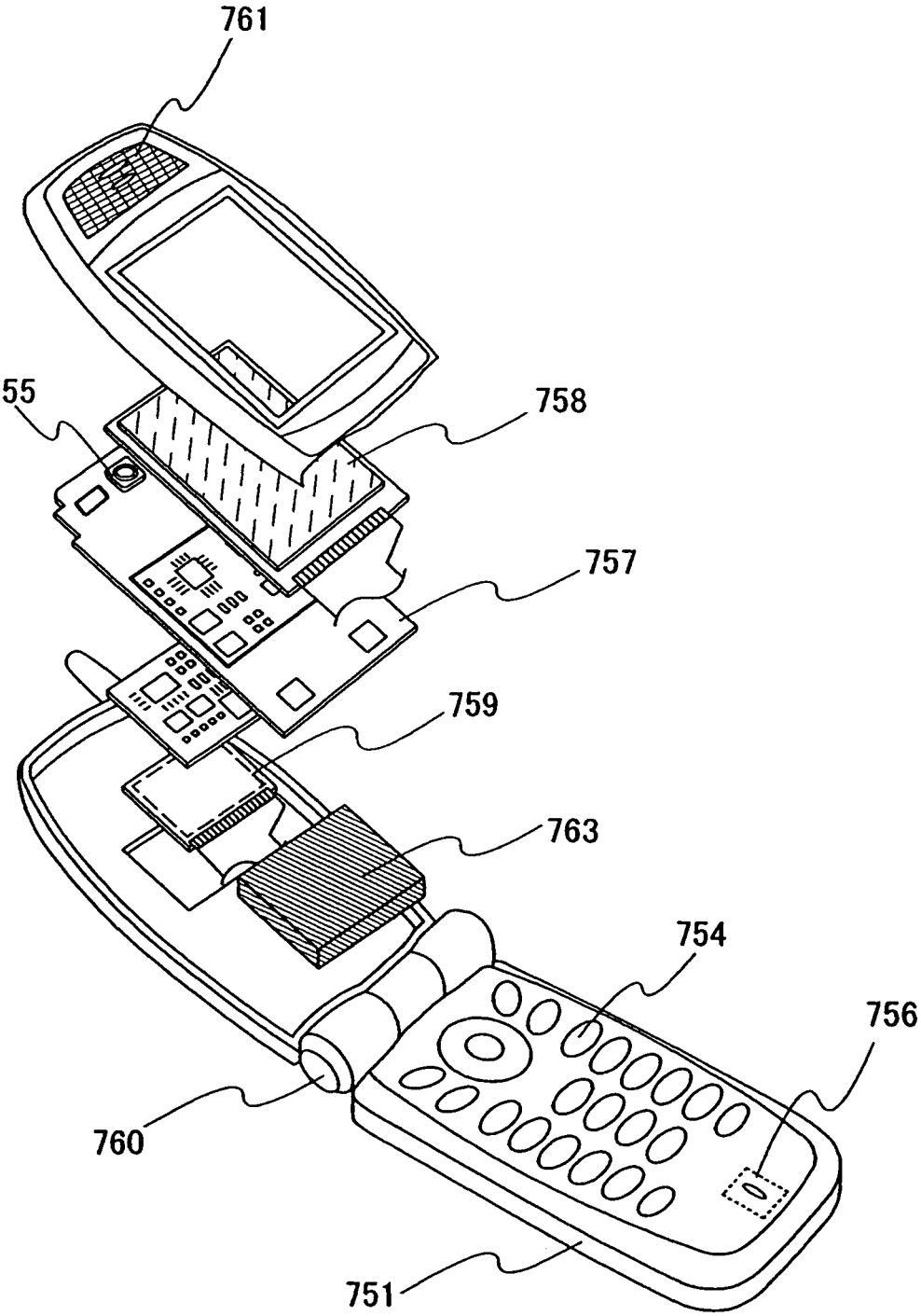
FIG. 21 is a diagram used to describe an example of an electronic device into which a central management device of the present invention can be installed.

FIG. 21 shows a cellular phone. The cellular phone has a main body 751, operation keys 754, an audio output 755, an audio input 756, a circuit substrate 757, a first display panel 758, a second display panel 759, a hinge 760, and a transparent material 761. A central management device 763 is mounted-inside the main body 751. By incorporation of the central management device in a cellular telephone, loss of the cellular telephone can be prevented. In addition, management of articles can easily be performed, and a shift toward a cellular telephone with higher added value can be achieved.

Figure 22:
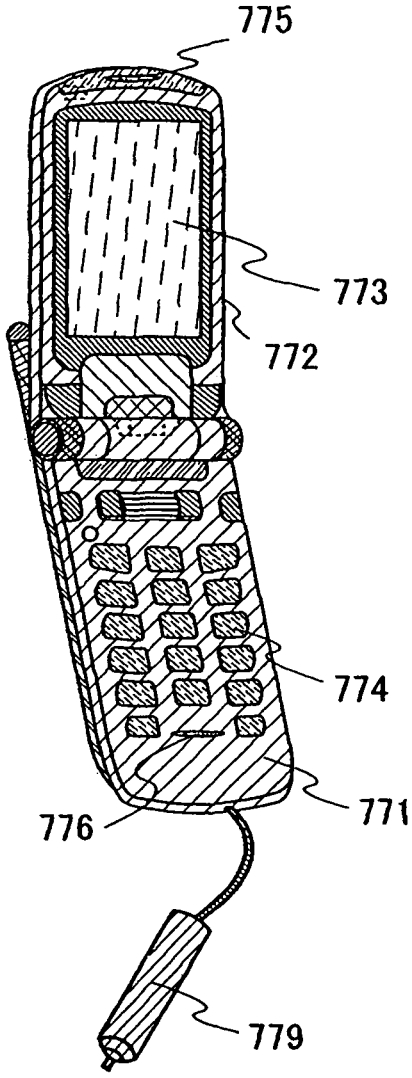
FIG. 22 is a diagram used to describe an example of an electronic device into which a central management device of the present invention can be installed.

It is to be noted that the interrogator of the central management device may be provided as a separate device and connected to the cellular telephone as an external device. A main body 771 of a cellular telephone shown in FIG. 22 has a case 772, a display panel 773, operation keys 774, an audio output 775, and an audio input 776. Furthermore, a portable reader/writer 779 that operates as an interrogator is connected to the cellular telephone shown in FIG. 22.

Figure 23:
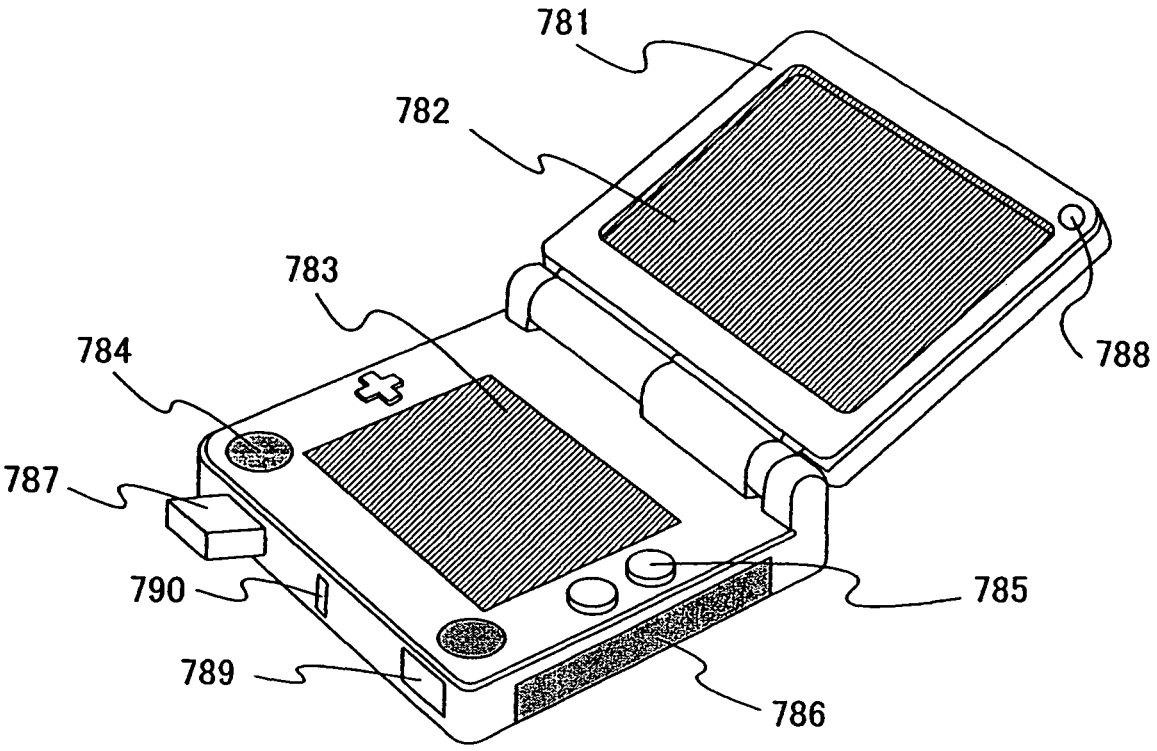
FIG. 23 is a diagram used to describe an example of an electronic device into which a central management device of the present invention can be installed.

Moreover, the central management device of the present invention may be incorporated into a portable game machine like the one shown in FIG. 23.

The portable game machine shown in FIG. 23 has a case 781, a first display 782, a second display 783, speakers 784, operation keys 785, a storage media insertion portion 786, a central management device 787, a sensor 788, a microphone 789, and an LED lamp 790. The portable game machine shown in FIG. 23 has functions for reading out programs and data stored in storage media and displaying the information on a display. In the structure shown in the diagram, the central management device 787 can be attached and removed and is connected to an input of the portable game machine. However, the present invention is not limited to this structure, and the central management device 787 may be incorporated into the portable game machine. By incorporation of a central management device of the present invention into a portable game machine, loss of the portable game machine can be prevented. Consequently, the present invention is particularly effective when the user of the portable game machine is an infant or a young child.

As described above, by the present invention, because the central response device that is worn by a human being (a user) and the central management device that has the controller and the interrogator, are each provided separately, loss of the central management device, which has the controller and the interrogator, of the article management system, itself can be prevented.

By the present invention, the article management system can be made to function more assuredly without any loss of the central management device. For this reason, management of articles can be carried out more easily and more efficiently. Consequently, loss of articles can be prevented, and financial losses can be prevented, as well. Furthermore, damage resulting from crime such as theft or the like can be prevented or reduced, as well.

Moreover, loss of the central response device can be prevented and the reliability of the article management system can be improved by the article that is to be worn being incorporated into an object that is not often removed or by being attached to a human being (a user).

If the detector is installed in the central response device, information can be communicated to the user more assuredly and article management can be performed more assuredly, as well. In addition, the number of variations in detection means can be increased.

(Embodiment Mode 2)

One aspect of an article management system to which the present invention is applied will be described with reference to FIG. 7, FIG. 8, and FIGS. 9A and 9B. In the present embodiment mode, an aspect, differing from that of Embodiment Mode 1, in which a response device is installed in each of a plurality of articles will be described.

Figure 7:
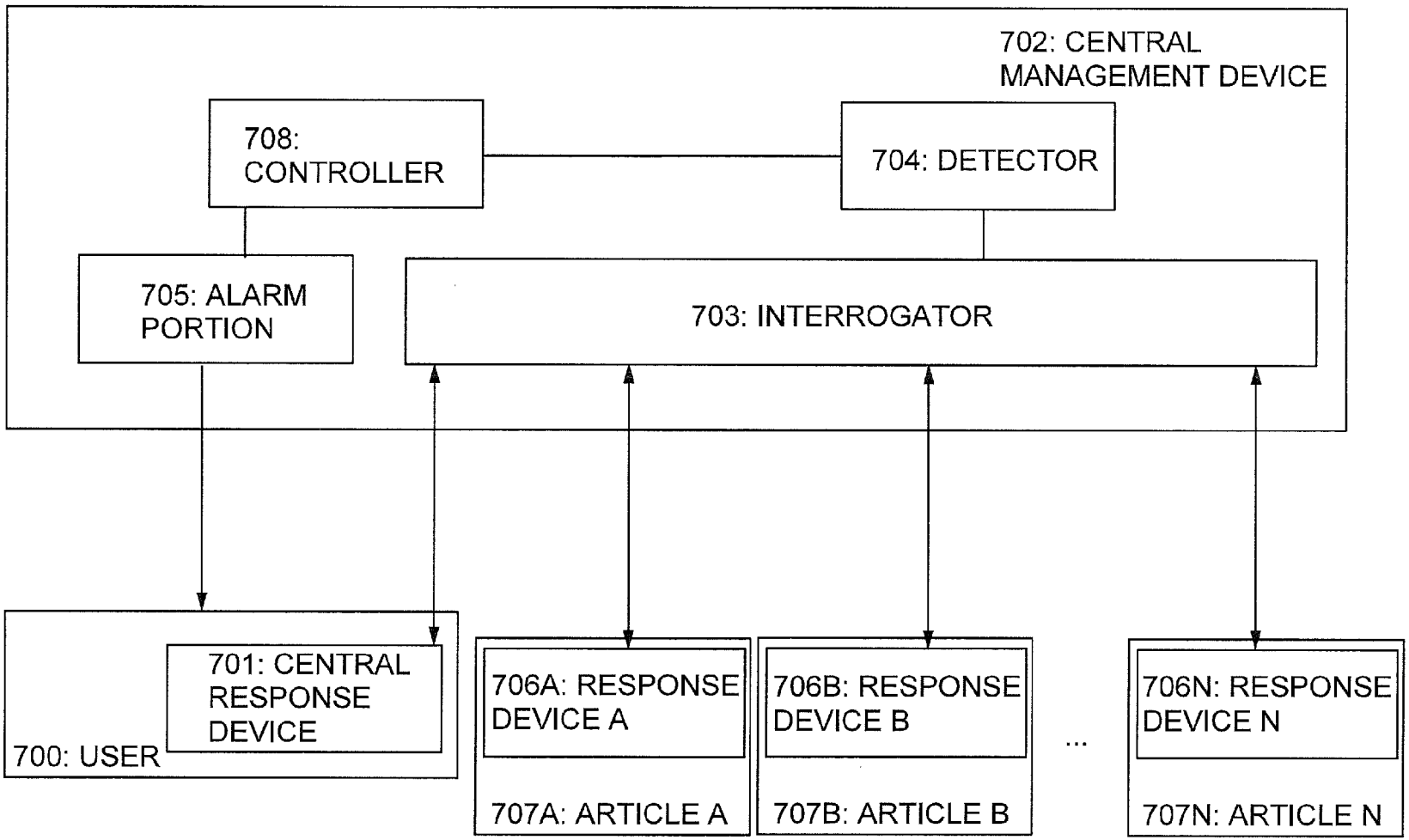
FIG. 7 is a diagram used to describe one aspect of the present invention.
Figure 8:
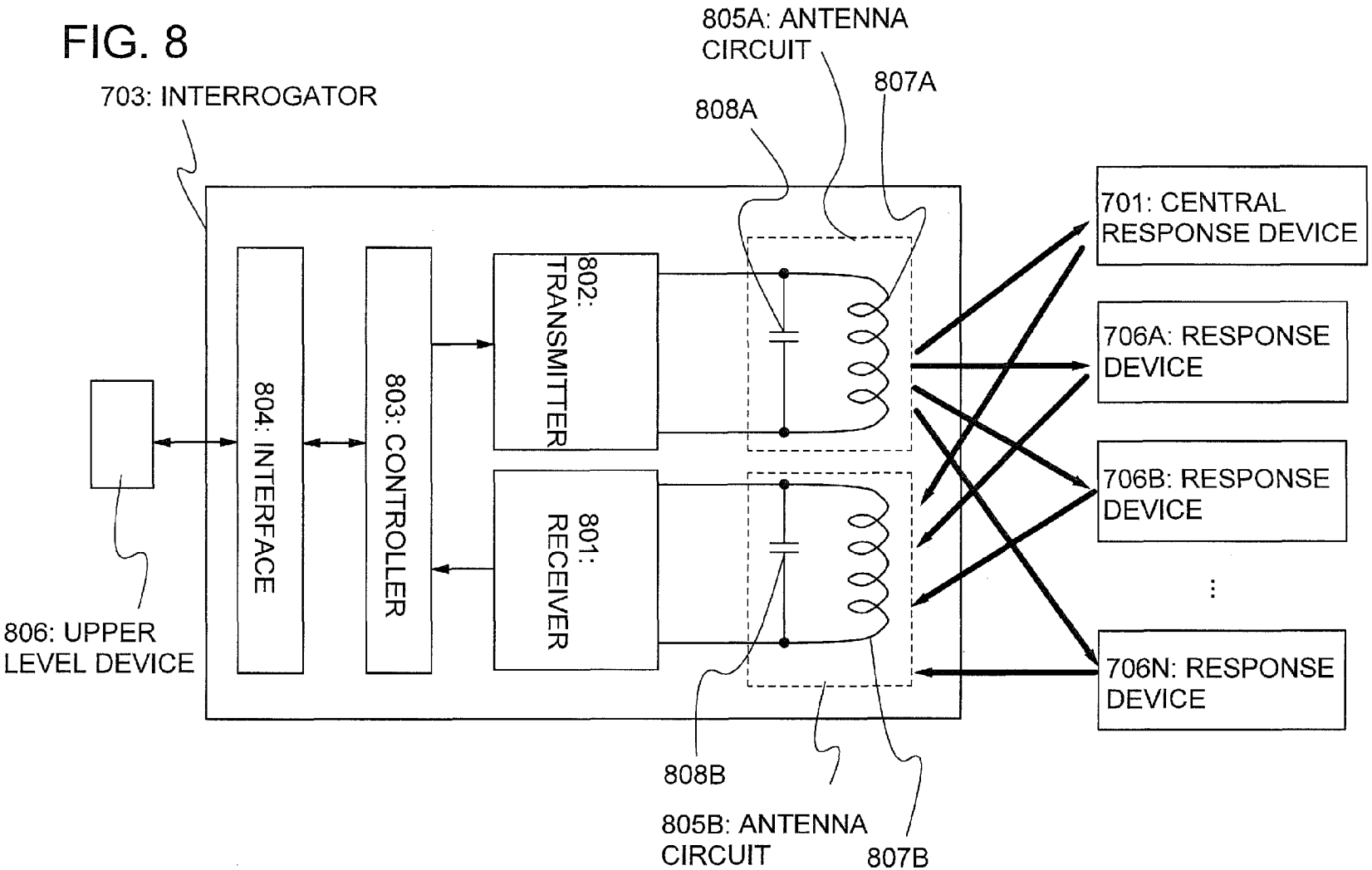
FIG. 8 is a diagram used to describe one aspect of an interrogator used in the present invention.

In FIG. 7, a block diagram used to describe an article management system of the present embodiment mode is shown. The article management system of the present embodiment mode has a user, a central management device, a plurality of response devices, and a plurality of articles. The central management device has an interrogator, a detector, an alarm portion, and a controller. The response device has one central response device and a plurality of response devices that are installed in articles. Each of the plurality of response devices (a response device 706A, a response device 706B, and a response device 706N) is installed into one of the plurality of articles (an article 707A, an article 707B, and an article 707N).

A user 700 is equipped with a central response device 701 and manages a central management device 702. The central response device 701 is provided separately from the central management device 702.

It is to be noted that the central response device 701 may be directly implanted into the user 700 or indirectly attached to the user 700. Here, "indirectly attached" refers to a case in which the central response device 701 is attached to an object that is to be worn by the user 700, the object that is to be worn by the user 700 is worn by the user 700, and accordingly, the central response device 701 is, in effect, attached to the user 700. By selection of an object that is not often removed for the article that is to be worn by the user, loss of the central response device can be prevented, and the reliability of the article management system can be improved.

The central response device 701 and an interrogator 703 communicate with each other wirelessly. Signals may be transmitted and received during a randomly determined period or transmitted and received continuously. The interrogator 703, a detector 704, and an alarm portion 705 are connected to a controller 708, and wired or wireless communication is performed. When the interrogator 703, the detector 704, and the alarm portion 705 are provided in the central management device and the central management device is made from one case, setting communication to wired communication is preferable.

Figure 20:
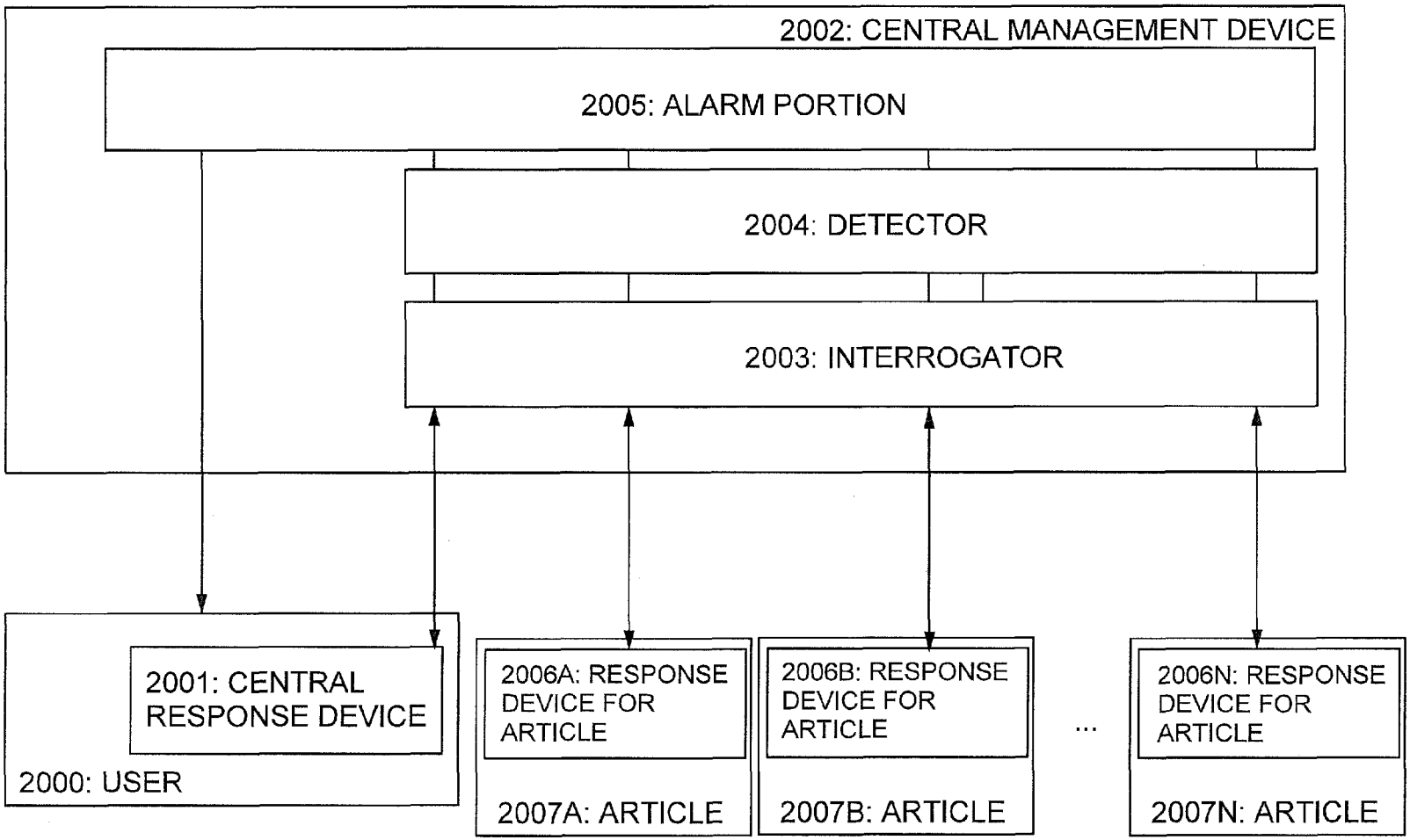
FIG. 20 is a diagram used to describe one aspect of the present invention.

It is to be noted that, as shown in FIG. 20, when there be no need for it, the central management device need not have a controller. For this case, the central management device of the article management system has an interrogator, a detector, and an alarm portion. An interrogator 2003, a detector 2004, and an alarm portion 2005 in FIG. 20 correspond to the interrogator 703, the detector 704, and the alarm portion 705, respectively.

A user 2000 is equipped with a central response device 2001 and manages a central management device 2002. The central response device 2001 is provided separately from the central management device 2002.

It is to be noted that the central response device 2001 may be attached to the user directly or attached indirectly. Here, "attached indirectly" refers to a case in which the central response device 2001 is attached to an object that is to be worn by the user 2000, the object that is to be worn by the user 2000 is worn by the user 2000, and accordingly, the central response device 2001 is, in effect, attached to the user 2000. By selection of an object that is not often removed for the article that is to be worn by the user, loss of the central response device can be prevented, and the reliability of the article management system can be improved.

The central response device 2001 along with a response device 2006A for an article that is installed in an article 2007A, a response device 2006B for an article that is installed in an article 2007B, a response device 2006N for an article that is installed in an article 2007N, and the like perform wireless communication with the interrogator 2003. Signals may be transmitted and received during a randomly determined period or transmitted and received continuously. The interrogator 2003 is connected to the detector 2004, the detector 2004 is connected to the alarm portion 2005, and each of these performs wired or wireless communication. When the interrogator 2003, the detector 2004, and the alarm portion 2005 are provided in the central management device and the central management device is made from one case, setting communication to wired communication is preferable.

The central response device 2001 and the interrogator 2003 communicate with each other wirelessly. Wireless communication may be performed such that signals are transmitted and received during a randomly determined period, or it may be performed such that signals are transmitted and received continuously. The interrogator 2003 is connected to the detector 2004, the detector 2004 is connected to the alarm portion 2005, and each of these performs wired or wireless communication. When the interrogator 2003, the detector 2004, and the alarm portion 2005 are provided in the central management device and the central management device is made from one case, setting communication to wired communication is preferable.

For a response device representing the central response device 701 and a response device 706A for an article of the present embodiment mode, the response device 200 described in Embodiment Mode 1 may be used.

The interrogator 703 communicates with the central response device 701 and the response device installed in an article of the response device 706A for an article and the like wirelessly. The interrogator 703 is also referred to as a reader/writer. An example of the interrogator 703 will be described with reference to FIG. 8. The interrogator 703 has a receiver 801, a transmitter 802, a controller 803, an interface 804, and an antenna circuit (an antenna circuit 805A and an antenna circuit 805B). The antenna circuit (the antenna circuit 805A and the antenna circuit 805B) has an antenna an antenna 807A and an antenna 807B) and a resonant circuit (a resonant circuit 808A and a resonant circuit 808B). The antenna (the antenna 807A and the antenna 807B) and the resonant circuit (the resonant circuit 808A and the resonant circuit 808B) make up an LC parallel resonant circuit.

The controller 803 controls the receiver 801 and the transmitter 802 based on data processing commands and data processing results from an upper-level device 806 via the interface 804. The transmitter 802 modulates data processing commands transmitted to the central response device 701 and the response device installed in an article of the response device 706A for an article and the like and outputs them from the antenna circuit 805A as electromagnetic waves. The receiver 801 demodulates signals received by the antenna circuit 805B and outputs them to the controller 803 as data processing results. When wireless signals are received, the antenna circuit 805B receives an electromagnetic force that is induced in the antenna circuit 805B by signals output from the central response device 701 and the response device installed in an article of the response device 706A for an article and the like as electrical signals. In addition, when signals are transmitted, an induced electric current is supplied to the antenna 805A, and signals are transmitted to the central response device 701 and the response device installed in an article of the response device 706A for an article and the like by the antenna circuit 805A.

For the detector 704 of the present embodiment mode, the detector 104 described in Embodiment Mode 1 may be used. For the alarm portion 705 of the present embodiment mode, the alarm portion 105 described in Embodiment Mode 1 may be used.

Here, operations of the article management system of the present invention shown in FIG. 7 will be described with reference to FIG. 9B.

First, the interrogator 703 transmits signals by carrier waves. The transmitted signals are received by the response device 200 (for example, the central response device 701). It is to be noted that unique individualized identification information (ID) for the central management device 702 is given in order to identify that the response device in the signal is the central response device 701 of the user 700. Furthermore, because there is a plurality of response devices in the present embodiment mode, unique individualized identification information (ID) for a response device is given for each of the response devices. When the transmitted signal is received by the central response device 701 via the antenna circuit 202, the signal is demodulated by the demodulation circuit 203 and input to the control circuit 206. By commands of the input signals, the individualized identification information (ID) for the central response device 701 is read from the memory circuit 207 and transmitted to the encoding circuit 208. The signal transmitted to the encoding circuit 208 is modulated by the modulation circuit 209 and transmitted to the interrogator 703 from the antenna circuit 202. The interrogator 703 transmits the received information to the upper-level device 806 and verifies that the individualized identification information (ID) is normal. The upper-level device 806 corresponds to the controller 708.

If the transmitted signal is not received by the central response device 701, the interrogator 703 does not receive any carrier waves because the central response device 701 does not transmit any signal. As a result, the detector 704 connected to the antenna 805B of the interrogator 703 operates and sends information to the controller 708. The controller 708 transmits commands to the alarm portion 705 in accordance with that information and makes the alarm portion 705 operate. The alarm portion 705 communicates information by the means that can be perceived by the user 700 based on the commands from the controller 708. It is to be noted that the information from the detector 704 may be communicated to the alarm portion 705 without being sent via the controller 708.

Even if the transmitted signal is received by the central response device 701, the interrogator 703 does not receive any carrier waves in the case of when the central response device 701 does not transmit a signal, either. As a consequence, the detector 704 connected to the antenna circuit 805B of the interrogator 703 operates and sends information to the controller 708. The controller 708 transmits commands to the alarm portion 705 in accordance with that information and makes the alarm portion 705 operate. The alarm portion 705 communicates information by the means that can be perceived by the user 700 based on the commands from the controller 708. It is to be noted that the information from the detector 704 may be communicated to the alarm portion 705 without being sent via the controller 708.

It is to be noted that the system described in the present embodiment mode has a plurality of response devices. For this reason, the structure may be one in which signals that are transmitted from the interrogator are transmitted to each response device during each fixed period. For example, a first signal transmitted from the interrogator is a signal that is transmitted to the central response device 701, and therefore, individualized identification information (ID) for the central management device 702 and individualized identification information (ID) for the central response device 701 are given. The central response device 701, the response device 706A for an article, the response device 706B for an article, and the response device 706N for an article that are each worn by the user 700 receive a first signal from the interrogator 703. Because the individualized identification information (ID) for the central management device 702 and the individualized identification information (ID) for the central response device 701 are given in the first signal, this individualized identification information (ID) is compared with individualized identification information (ID) stored in the memory circuit of the relevant response device and sent back when the two match. Here, "sent back" refers to when each circuit of the relevant response device is made to operate according to a signal received from the antenna circuit of the response device and the individualized identification information (ID) stored in the memory circuit of the relevant response device is transmitted from the antenna circuit. At this time, the transmitted signal is not the same as the signal that is transmitted from the interrogator to the response device but is a signal that gives information showing that it is a signal transmitted from the response device to the interrogator. The interrogator that receives the signal transmitted from the response device transmits the relevant information to the controller, and the controller verifies that the relevant response device is present within the range of standard communication distances.

Figure 9A:
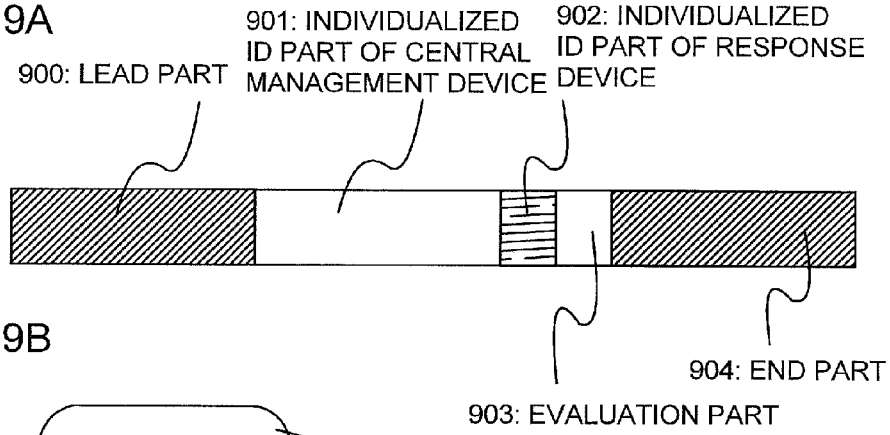
FIGS. 9A and 9B are flowcharts used to describe one aspect of the present invention.

In FIG. 9A, a conceptual diagram of data given in the signals that are transmitted and received is shown. The data of FIG. 9A includes a lead part 900, an individualized identification information (ID) part 901 of a central management device, an individualized identification information (ID) part 902 of a response device, a data identification evaluation part 903, and an end part 904.

The lead part 900 and the end part 904 each include information needed for transmission and reception of signals, encoding, and decoding. In addition, data needed for encryption may be included as well.

Because the individualized identification information (ID) part 901 of a central management device is used to distinguish one central management device from another central management device, the relevant central management device has unique individualized identification information (ID).

Because the individualized identification information (ID) part 902 of the response device is used to distinguish one of a plurality of response devices associated with the central management device from the other response devices, the relevant response device has unique individualized identification information (ID).

The data identification evaluation part 903 has information used to distinguish whether relevant data is transmitted to the response device from the interrogator or is transmitted from the response device to the interrogator.

If transmitted data and received data are configured as in the conceptual diagram shown in FIG. 9A, interference between signals can be prevented.

When the individualized identification information (ID) included in the first signal that the response device received does not match the individualized identification information (ID) stored in the memory circuit in the response device, the control circuit of the relevant response device determines that the first signal is not a signal that has been transmitted to the relevant response device and does not operate. Moreover, the control circuit does not operate when the data type of the received signal does not match, either.

When a signal intended for the interrogator 703 is transmitted from the response device and the control circuit determines that transmission and reception of the first signal are performed normally, the interrogator 703 transmits a second signal after a certain period of time has lapsed. The second signal is transmitted and received in the same way as the first signal is. When the number of response devices provided with the central response device and installed in articles is n, the same process is performed up through the (n+1)th signal. The structure may be one in which, after the process for signals up through the (n+1)th signal is completed, the first signal is transmitted again.

The aforementioned operations will be described with reference to FIG. 9B. First, a process is begun (Step 910). A signal A is transmitted from the interrogator to a response device m (where m is a given integer, m=1, 2, 3, . . . , n) (Step 911). When the response device m receives the signal A (Step 912), the response device m performs a given process, and a signal B is transmitted from the response device m to the interrogator (Step 913). If the response device m does not receive the signal A, the detector detects an aberration (Step 915). When the interrogator receives the signal B (Step 914), the process proceeds to the loop edge of the end of a loop a (Step 922). If the interrogator does not receive the signal B, the detector detects an aberration (Step 915).

In the aforementioned operations, when the detector detects an aberration (Step 915), the detector transmits a signal to report to the controller that there is an aberration (Step 916). The controller transmits a command to make the alarm portion operate, based on the relevant information (Step 917). In accordance with the relevant information, the alarm portion communicates information to the user (Step 918) so that the user is informed of the aberration. Then, the process proceeds to the loop edge of the end of the loop a (Step 922).

When the process goes from the loop edge of the end of the loop a (Step 922) to the loop edge of the start of the loop a (Step 921), m increases by 1. The loop starts with m=1 and keeps repeating itself until m=n+1. When m=n+2, the operation finishes normally without any looping (Step 919).

Figure 9B:
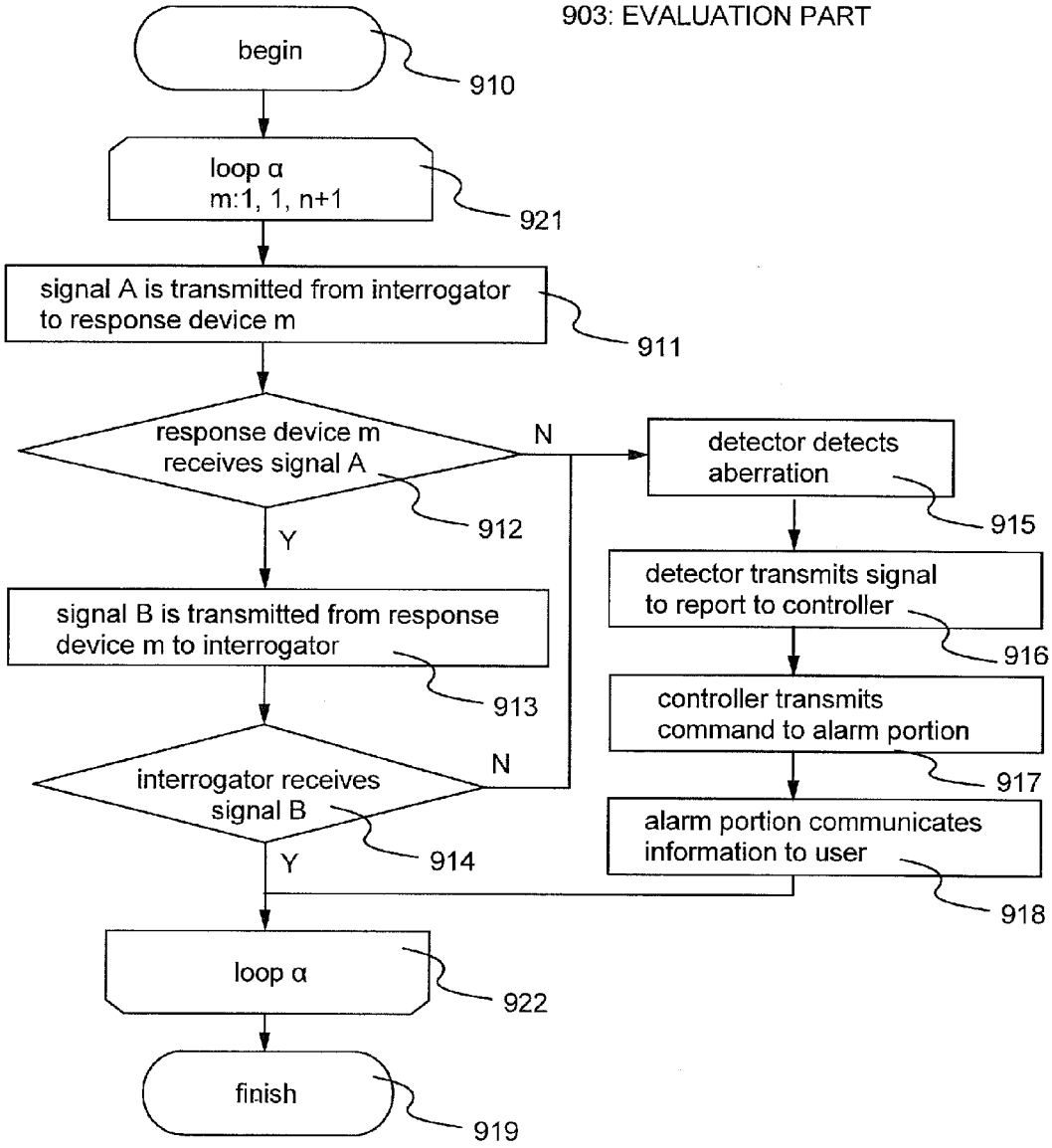

FIG. 9B shows the flow of a series of processes; however, if another process is started after the series of processes in FIG. 9B finishes, the operations can be performed continuously.

As described above, when a signal from the interrogator is not received by the response device or when a signal from the response device is not received by the interrogator, the detector operates and makes the alarm portion operate. By operation of the alarm portion, the user recognizes that there is an aberration in communication between the response device and the interrogator. When the user recognizes that there is an aberration, he or she may respond by searching for the response device or doing the like.

It is to be noted that the interrogator 703, the detector 704, and the alarm portion 705 provided in the central management device 702 may each have a separate power supply or they may share one common power supply that is provided in the central management device 702. When the interrogator 703, the detector 704, and the alarm portion 705 of the central management device 702 are provided in one case, it is preferable that they share a common power supply.

It is to be noted that, in the present embodiment mode, a case where the person (hereinafter referred to as a perceiver) who perceives information that is provided by the alarm portion 705 and the user were the same person was described; however, the user and the perceiver need not be the same person.

It is to be noted that, in the present embodiment mode, a structure in which the central management device 702 has the controller 708 is described; however, if each device has a control circuit or the like that has the same function as that of the controller 708, the controller 708 need not necessarily be provided.

It is to be noted that when the central management device 702 is incorporated as part of another electronic device, the interrogator 703, the detector 704, and the alarm portion 705 provided in the central management device 702 may be substituted for with devices that have the same functions. For example, when the central management device is incorporated into a cellular telephone, a device in the cellular telephone that produces a sound when a phone call is received may be used instead of the alarm portion.

As described above, by the present invention, because the central response device that is worn by a human being (a user) and the central management device that has the controller and the interrogator, are each provided separately, loss of the central management device, which has the controller and the interrogator, of the article management system, itself can be prevented.

As described above, by the present invention, the article management system can be made to function more assuredly without any loss of the central management device. For this reason, management of articles can be carried out more easily and more efficiently. Consequently, loss of articles can be prevented, and financial losses can be prevented, as well. Furthermore, damage resulting from crime such as theft or the like can be prevented or reduced, as well.

Moreover, loss of the central response device can be prevented and the reliability of the article management system can be improved by the article that is to be worn being incorporated into an object that is not often removed or by being attached to a human being (a user).

If the alarm portion is installed in the central response device, information can be communicated to the user more assuredly and article management can be performed more assuredly, as well.

Furthermore, by installation of a response device in each of a plurality of articles, as described in the present embodiment mode, management of a plurality of articles can be performed more assuredly.

(Embodiment Mode 3)

Figure 15A:
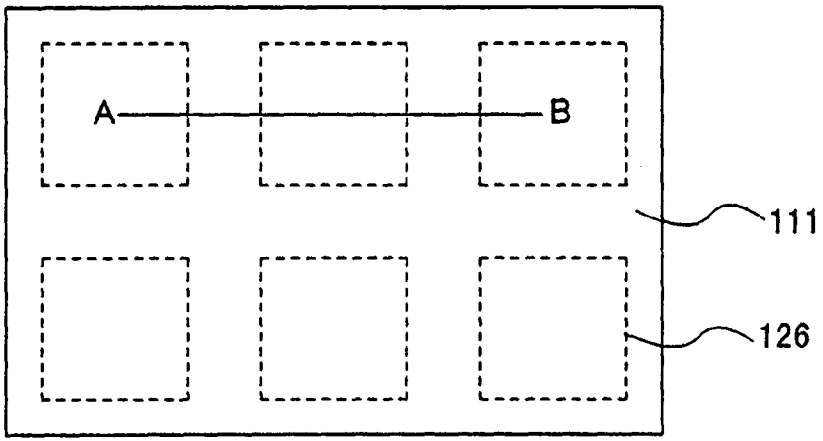
FIGS. 15A to 15B are diagrams used to describe a manufacturing method of a response device used in the present invention.
Figure 15B:
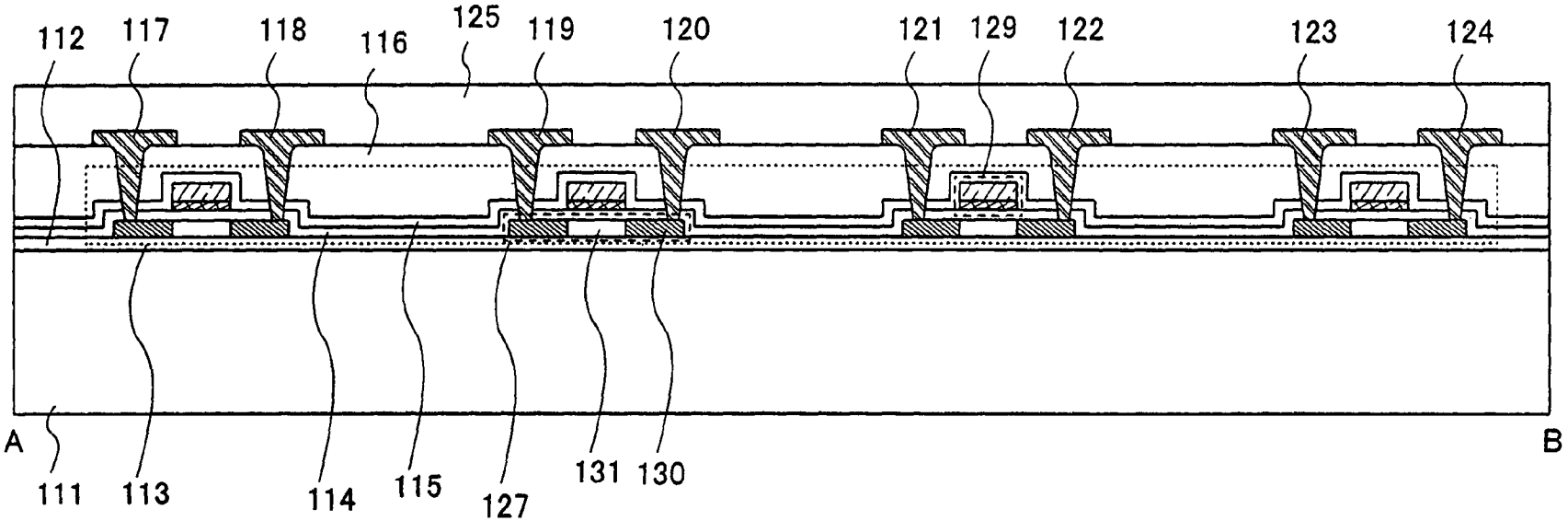
Figure 16A:
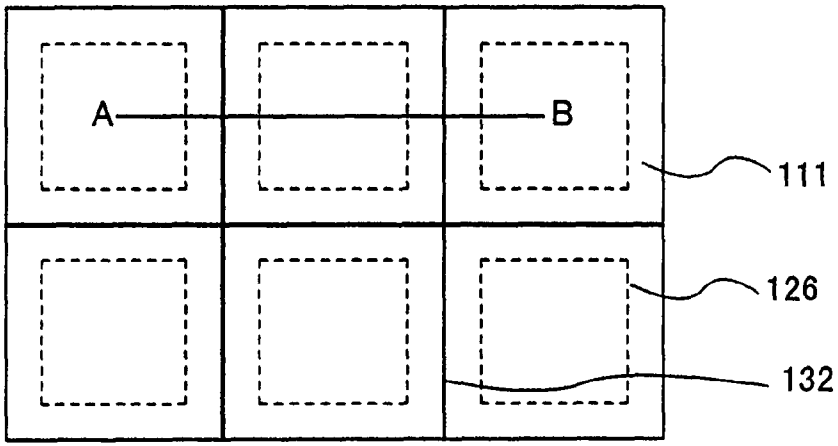
FIGS. 16A to 16B are diagrams used to describe a manufacturing method of a response device used in the present invention.
Figure 16B:
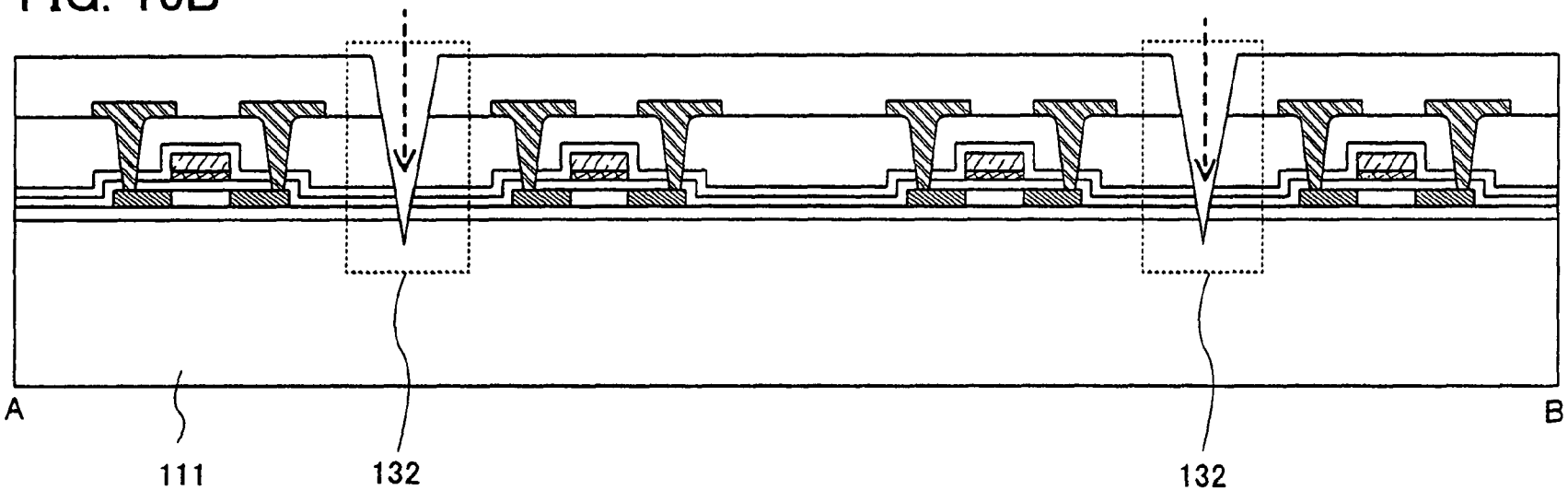
Figure 17A:
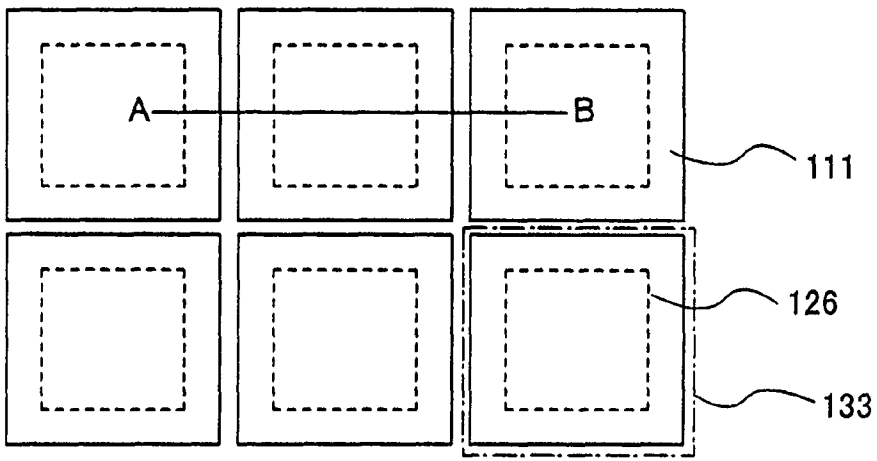
FIGS. 17A to 17B are diagrams used to describe a manufacturing method of a response device used in the present invention.
Figure 17B:
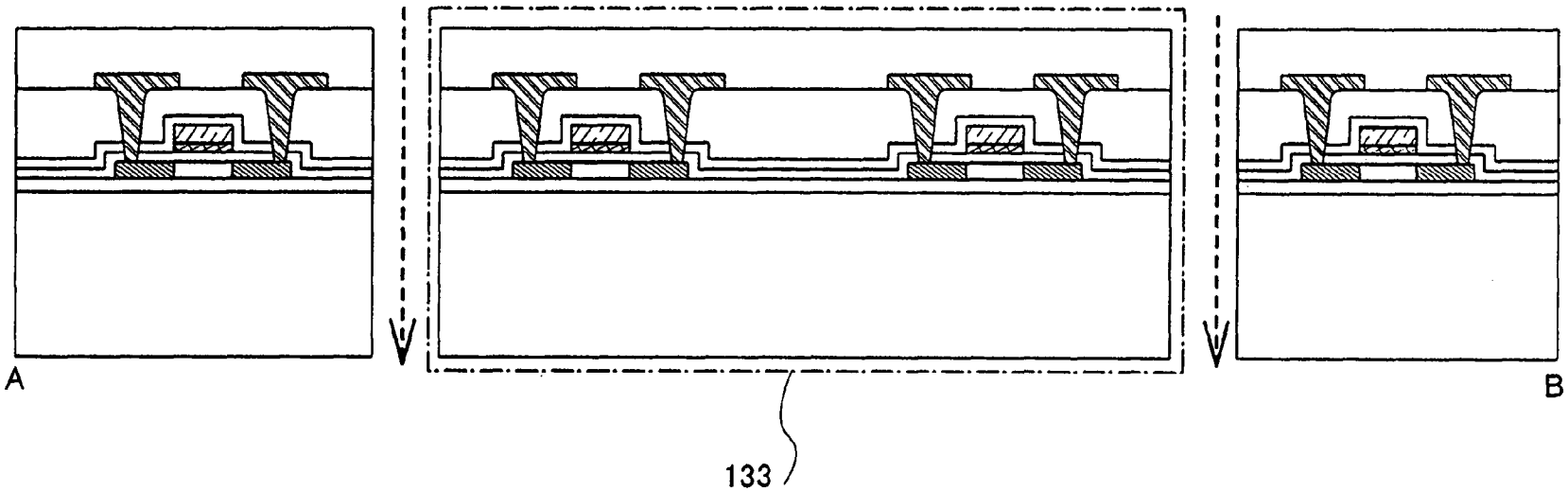

In the present embodiment mode, an example of a manufacturing method for a semiconductor device used as the response device of the present invention will be described with reference to drawings. It is to be noted that, hereinafter, a case in which six thin film integrated circuits are formed over a substrate 111 will be described. In FIG. 15A, FIG. 16A, and FIG. 17A, a region in which one of the thin film integrated circuits is provided corresponds to a region 126 that is enclosed by a dotted line. FIG. 15B, FIG. 16B, and FIG. 17B are each diagrams of a cross section taken from point A to point B in FIG. 15A, FIG. 16A, and FIG. 17A, respectively.

First, an insulating layer 112 is formed over one surface of the substrate 111 (refer to FIG. 15B). Next, a layer that contains a plurality of transistors 113 is formed over the insulating layer 112. Then, an insulating layer 115 and an insulating layer 116 are formed over the layer that contains the plurality of transistors 113. Next, an opening is formed in an insulating layer 114, the insulating layer 115, and the insulating layer 116. Conductive layers 117 to 124, connected to a source region or drain region of each of the plurality of transistors 113 via the opening, are formed. Then, an insulating layer 125 is formed so as to cover the conductive layers 117 to 124.

The substrate 111 corresponds to a glass substrate, a plastic substrate, a silicon substrate, a quartz substrate, or the like. Preferably, a glass substrate or a plastic substrate is used for the substrate 111. Making a glass substrate or a plastic substrate as a substrate that is one meter long or longer on one side and making it into a desired shape are both easily done. Consequently, for example, for a square shape, if a large glass substrate or plastic substrate that is one meter long or longer on each side is used, productivity can be increased dramatically. This point is a huge advantage compared to when round silicon substrates are used. It is to be noted that, when silicon substrates are used, elements, not thin film transistors, should be formed directly on the substrate.

The insulating layer 112 has the function of prevention of diffusion of impurities from the substrate 111. The insulating layer 112 is formed as a single layer or stack of layers containing an oxide of silicon or a nitride of silicon by a sputtering method, a plasma CVD method, or the like. An oxide of silicon material is a substance that contains silicon and oxygen and corresponds to silicon oxide, silicon oxide that contains nitrogen, and the like. A nitride of silicon material is a substance that contains silicon and nitrogen and corresponds to silicon nitride, silicon nitride that contains oxygen, and the like. It is to be noted that the insulating layer 112 need not be provided if there is no need for it.

Each of the plurality of transistors 113 has a semiconductor layer 127, the insulating layer 114, and a conductive layer 129 that is a gate electrode layer. The semiconductor layer 127 contains impurity regions 130, each functioning as a source region or drain region, and a channel formation region 131. The impurity region 130 is doped with an impurity element imparting n-type or p-type conductivity. Specifically, the impurity region 130 is doped with an impurity element imparting n-type conductivity (an element belonging to group 15 of the periodic table of the elements, for example, phosphorus or arsenic) or an impurity element imparting p-type conductivity (for example, boron). The insulating layer 114 corresponds to a gate insulating layer.

It is to be noted that, in the structure shown in the drawing, only the plurality of transistors 113 are formed; however, the present invention is not to be constrained to this structure. The elements formed over the substrate 111 may be adjusted as appropriate based on the application of the semiconductor device. For example, a conductive layer used to function as a plurality of transistors may be formed over the substrate 111 or a conductive layer used to function as an antenna and a plurality of transistors may be formed over the substrate 111. It is to be noted that, for a conductive layer used to function as an antenna, not only one layer but a plurality of layers may be formed. In addition, a plurality of transistors and a memory element (for example, a transistor, a memory transistor, or the like) may be formed over the substrate 111. Furthermore, when a semiconductor device that is made to have functions for control of circuits, generation of signals, and the like (for example, a CPU, a signal generation circuit, or the like) is formed, a transistor may be formed over the substrate 111. Moreover, in addition to what is described above, other elements, such as resistive elements, capacitive elements, and the like, may also be formed, if necessary.

The insulating layer 115 and the insulating layer 116 may each be formed as a single layer or stack of layers by an inorganic material or an organic material, using a spin-on glass (SOG) method, a droplet discharge method, a screen printing method, or the like. For example, a nitride of silicon that contains oxygen may be formed for the insulating layer 115, and an oxide of silicon that contains nitrogen may be formed for the insulating layer 116.

Next, grooves 132 are formed in one or a plurality of layers selected from the insulating layer 114, the insulating layer 115, the insulating layer 116, and the insulating layer 125 that are provided in the substrate 111, the insulating layer 112, and the layer that contains the plurality of transistors 113 by selective irradiation, that is, irradiation of a predefined location, with a laser beam (refer to FIGS. 16A and 16B). It is to be noted that, in the structure shown in the drawings, the insulating layer 112, the insulating layer 114, the insulating layer 115, and the insulating layer 116 are cut by the laser beam, and the groove 132 is formed in the substrate 111. A mechanical means may also be used in the formation of the groove 132.

The laser is made up of a laser medium, an excitation source, and a resonator. For lasers, if classified according to medium, there are gas lasers, liquid lasers, and solid-state lasers; if classified according to oscillation characteristics, there are free electron lasers, semiconductor lasers, and X-ray lasers. In the present invention, any of these lasers may be used. It is to be noted that, preferably, a gas laser or a solid-state laser is to be used; even more preferably, a solid-state laser is to be used.

For gas lasers, there are helium-neon lasers, carbon dioxide gas lasers, excimer lasers, and argon-ion lasers. For excimer lasers, there are noble gas excimer lasers and noble gas halide excimer lasers. In noble gas excimer lasers, there is oscillation by three types of excited molecules, argon, krypton, and xenon. For argon-ion lasers, there are noble gas ion lasers and metal vapor ion lasers.

For liquid lasers, there are inorganic liquid lasers, organic chelate lasers, and dye lasers. For inorganic liquid lasers and organic liquid lasers, a rare earth ion, such as neodymium or the like, used in solid-sate lasers, is used for the laser medium.

For the laser medium used by a solid-state laser, the laser medium is a solid-state host material that is doped with an active species that has laser action. The solid-state host material is crystal or glass. For the crystal, there is YAG (yttrium aluminum garnet crystal), YLF, $YVO_4$, $YAlO_3$, sapphire, ruby, and alexandrite. Furthermore, for the active species that has laser action, for example, there are trivalent ions ($Cr^{3+}$, $Nd^{3+}$, $Yb^{3+}$, $Tm^{3+}$, $Ho^{3+}$, $Er^{3+}$, and $Ti^{3+}$).

It is to be noted that, for the laser used in the present invention, a continuous wave laser or a pulsed laser can be used. Irradiation conditions (for example, frequency, power density, energy density, beam profile, and the like) for the laser beam can be set as appropriate in consideration of the thicknesses, materials, and the like of the substrate 111, the insulating layer 112, the insulating layer 114, the insulating layer 115, the insulating layer 116, and the insulating layer 125.

When the substrate 111 is a glass substrate, for the laser, preferably, a solid state laser with a wavelength greater than or equal to 1 nm and less than or equal to 380 nm, which is in the ultraviolet region of the electromagnetic spectrum, is used. Even more preferably, an Nd:$YVO_4$ laser with a wavelength greater than or equal to 1 nm and less than or equal to 380 nm, which is in the ultraviolet region of the electromagnetic spectrum, is used. This is because, with a laser that has a wavelength in the ultraviolet region of the electromagnetic spectrum, more so than with a laser that has a wavelength on the longer side of the electromagnetic spectrum, light is more easily absorbed by the substrate (in particular, by a glass substrate). Furthermore, an abrasion process is easily performed with an Nd:$YVO_4$ laser, in particular, as well. When the substrate 111 is a plastic substrate, a solid-state laser with a wavelength greater than or equal to 1 nm and less than or equal to 350 nm may be used. It is preferable that an Nd:$YVO_4$ laser be used in this case, as well.

Next, the substrate 111, the insulating layer 112, the insulating layer 114, the insulating layer 115, the insulating layer 116, and the insulating layer 125 are irradiated with a laser beam, as selected, and cut (refer to FIGS. 17A and 17B). Furthermore, the substrate 111, the insulating layer 112, the insulating layer 114, the insulating layer 115, the insulating layer 116, and the insulating layer 125 may be cut mechanically using the groove that has been formed. By use of the above step, a stacked-layer body 133 of the substrate 111 and a plurality of transistors 113 can be obtained.

Figure 18A:
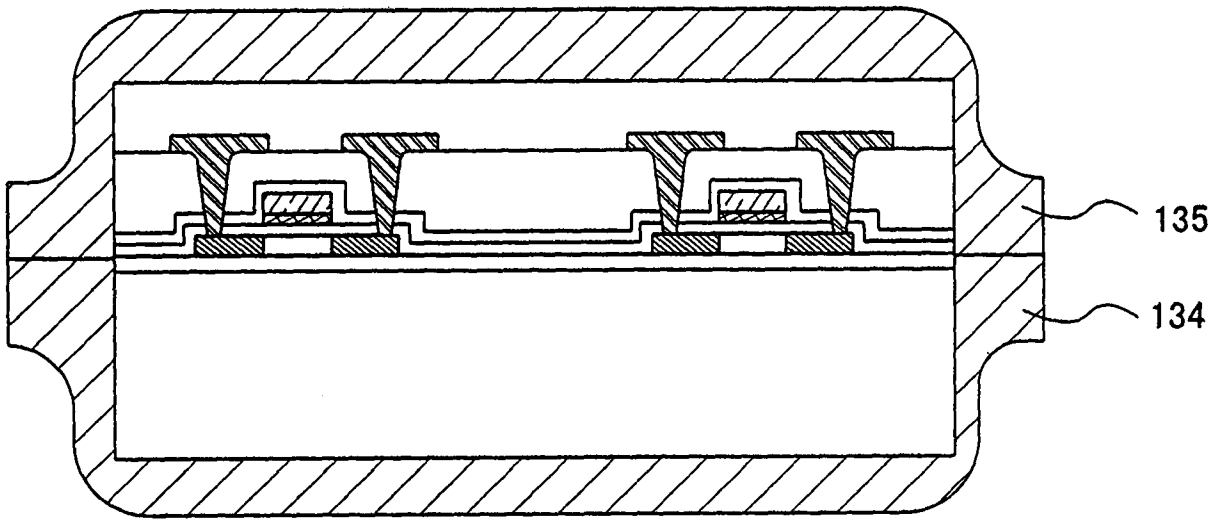
FIGS. 18A to 18B are diagrams used to describe a manufacturing method of a response device used in the present invention.

Next, if necessary, the stacked-layer body 133 of the substrate 111 and the plurality of transistors 113 is sealed by use of a film 134 and a film 135 (refer to FIG. 18A). The film 134 and the film 135 are made from a material such as polyethylene, polycarbonate, polypropylene, polyester, vinyl, polyvinyl fluoride, vinyl chloride, ethylene vinyl acetate, urethane, or polyethylene terephthalate or a fibrous material (for example, paper). Each film may be formed as a single layer or as a plurality of films stacked together. In addition, an adhesive layer may be provided on the top surface of each film. The adhesive layer corresponds to a layer that contains an adhesive such as a polyester-based or a polyolefin-based thermoplastic resin, a thermosetting resin, an ultraviolet cured resin, a polyvinyl acetate adhesive, a vinyl copolymer resin-based adhesive, an epoxy resin-based adhesive, a polyurethane resin adhesive, a rubber-based adhesive, an acrylic resin-based adhesive, or the like.

The surface of each of the film 134 and the film 135 may be coated with a silicon dioxide (silica) powder. By coating of the film 134 and the film 135, a waterproofing property can be maintained even under an environment with high temperatures or high humidity. That is, moisture resistance can be increased. Alternatively, the surface of each of the film 134 and the film 135 may be coated with a conductive material such as indium tin oxide or the like. The coated material is charged with static electricity and can protect the plurality of transistors 113 from static electricity. That is, the coated material can be made to have an antistatic function. Furthermore, the surface of each of the film 134 and the film 135 may be coated with a material that contains carbon as its main component (for example, diamond-like carbon, carbon that contains nitrogen, or the like). By coating, mechanical strength is increased, and degradation and breakdown of a semiconductor device can be suppressed. Furthermore, the film 134 and the film 135 may be formed of a mixture of a base material (for example, a resin) and a material that contains silicon dioxide, a conductive material, or carbon as its main component. Moreover, the film 134 and the film 135 can be made to have an antistatic function by application of a surfactant material to the surface of each of the film 134 and the film 135 or by direct kneading of a surfactant material into the film 134 and the film 135.

Sealing of the plurality of transistors 113 by the film 134 and the film 135 is performed by melting of surface layers of each of the film 134 and the film 135 or adhesive layers on the surface of each of the film 134 and the film 135 by heat treatment. In addition, the film 134 and the film 135 may be attached by performance of pressure treatment, if needed.

For a semiconductor device that uses the response device of the present invention, a stacked-layer body 133 of the substrate 111 and the plurality of transistors 113 may be provided between the film 134 and the film 135. By the above aspect, penetration of harmful gases, penetration of water, and penetration of impurities can be suppressed. Consequently, degradation and breakdown of the plurality of transistors 113 can be suppressed, and reliability can be improved. In addition, because breakdown or the like occurring during the manufacturing process can be prevented, yield can be improved.

It is to be noted that a conductive layer that functions as an antenna may be provided over either one of the film 134 or the film 135 or over both the film 134 and the film 135. Then, in sealing of the stacked-layer body 133 with the plurality of transistors 113 by the film 134 and the film 135, the conductive layer formed over the film 134 or the film 135 or over both the film 134 and the film 135 may be connected electrically to the plurality of transistors 113. In this case, an exposed conductive layer used for connection may be formed over the stacked-layer body 133 with the plurality of transistors 113. Then, in sealing of the stacked-layer body 133 with the plurality of transistors 113, the aforementioned conductive layer used for connection is set so as to be connected to the conductive layer formed over the film 134 or the film 135 or over both the film 134 and the film 135.

Figure 18B:
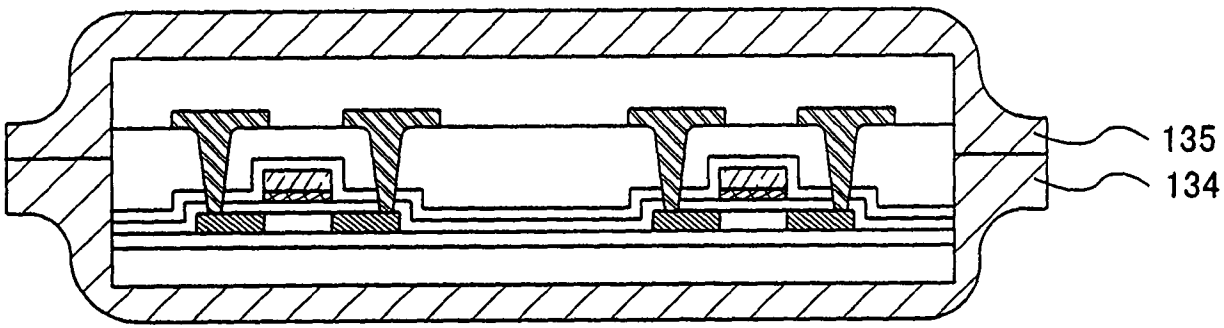

It is to be noted that the substrate 111 may be thinned by performance of either grinding or polishing or both grinding and polishing on the other surface of the substrate 111 by use of either a grinding device (for example, a grinder) or a polishing device (for example, a whetstone) or both a grinding device and a polishing device. After the substrate 111 is thinned, the insulating layer 112, the insulating layer 114, the insulating layer 115, the insulating layer 116, and the thinned substrate 111 are cut by irradiation with a laser beam, as selected. Next, by use of the film 134 and the film 135, the stacked-layer body 133 of the substrate 111 and the plurality of transistors 113 are sealed (refer to FIG. 18B). It is to be noted that the substrate 111 should be thinned by performance of either grinding or polishing or both grinding and polishing. Alternatively, the substrate 111 may be peeled away.

It is to be noted that, in performance of either grinding or polishing or both grinding and polishing, a film used to protect the insulating layer 125 should be provided and affixed over the insulating layer 125. After the film is affixed over the insulating layer 125, either grinding or polishing or both grinding and polishing of the other surface of the substrate 111 may be performed. It is to be noted that a film over whose surface a UV cured adhesive is provided may be used for the film that is provided over the insulating layer 125. Furthermore, after either grinding or polishing or both grinding and polishing are performed, the film that is provided over the insulating layer 125 may be left remaining as is or may be removed.

In this way, by thinning of the substrate 111, cutting of the insulating layer 112, the insulating layer 114, the insulating layer 115, the insulating layer 116, and the substrate 111 can be performed easily and in a short amount of time using a laser beam. Furthermore, by thinning of the substrate, a semiconductor device that has flexibility can be offered. By the substrate being given flexibility, design characteristics are improved, and implementation of articles with flexible shapes can be performed easily.

In addition, in the above step, the shape into which the substrate 111 is cut is a simple square shape; however, the present invention is not limited to this and can be formed in a variety of different shapes. By ingenuity in the design of the shape, the upper surface shape of the stacked-layer body that includes the substrate 111 can be formed to have an inner angle of 90° or more (for example, as a polyhedral shape such as a hexagonal shape or the like) or to have no angles (for example, as a circular shape or an elliptical shape), and handling at the time of transport can be made easier. In addition, chipping, cracking, and burring that occur with implementation into products can be prevented.

Furthermore, by application of the steps described in the present embodiment mode to manufacturing of the central response device of the present invention, handling of finished articles can be made easier, reliability can be increased, and a safe response device can be offered.

(Embodiment Mode 4)

In the present embodiment mode, an aspect in which a battery is installed in a response device will be described. Provision of a battery in a response device is effective in cases in which, for example, even if the response device receives a signal from the interrogator, not enough electric power can be secured from the power supply of the response device and the response device cannot send a signal with a high enough voltage. In this kind of case, if an aberration is detected, the system becomes unable to function, which is not very desirable. Consequently, the system can be made to be even more reliable by installation of a battery in the central response device.

Figure 10:
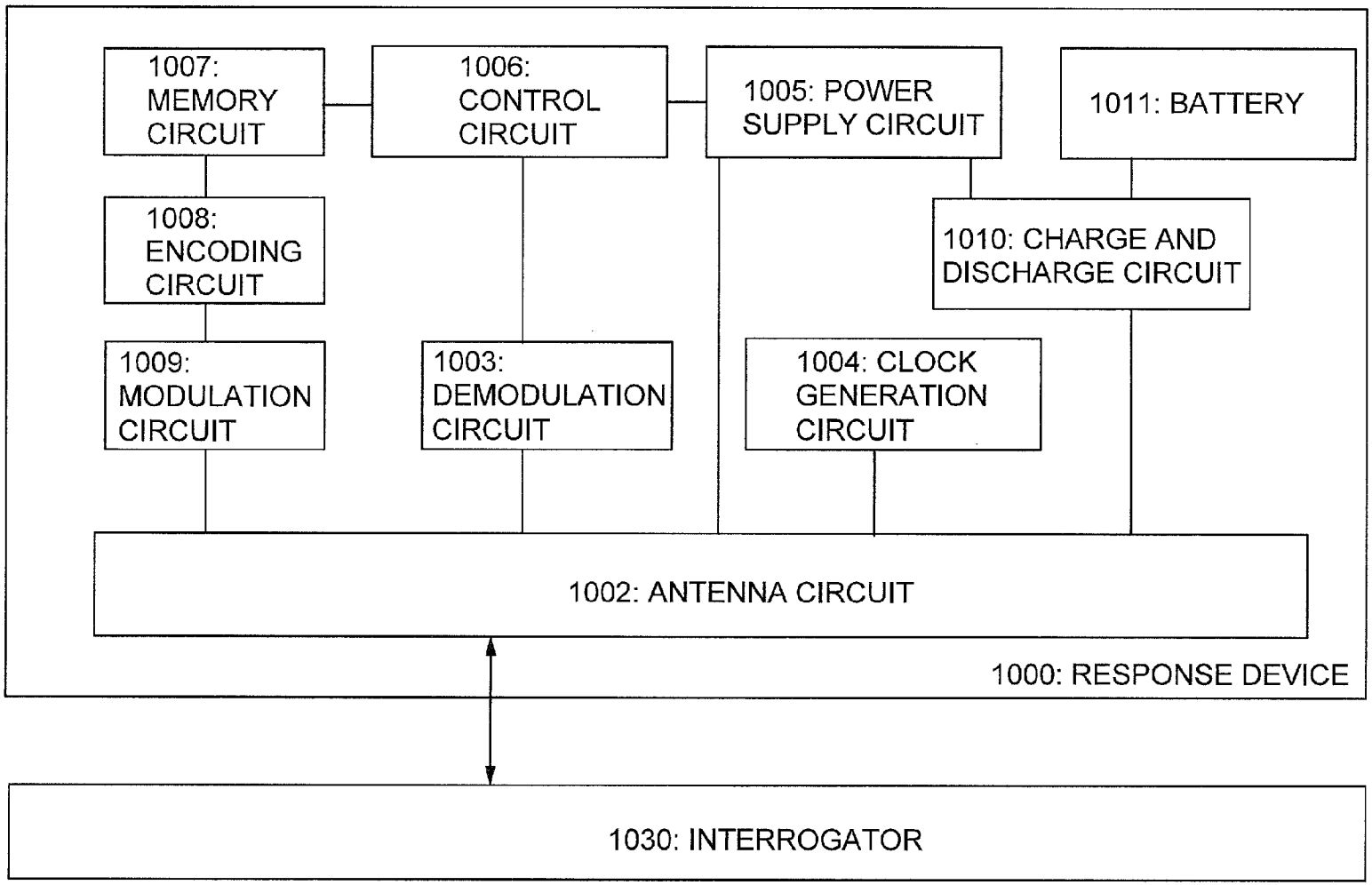
FIG. 10 is a diagram used to describe one aspect of a response device used in the present invention.

An example of a structure in which a battery is installed in a response device of the present invention is shown in FIG. 10. A response device 1000 has an antenna circuit 1002, a demodulation circuit 1003, a clock generation circuit 1004, a power supply circuit 1005, a control circuit 1006, a memory circuit 1007, an encoding circuit 1008, and a modulation circuit 1009. It is to be noted that the response device in which a battery is installed as shown in FIG. 10 is sometimes referred to as active-type.

The antenna circuit 1002 converts carrier waves supplied from an interrogator 1030 into alternating current electrical signals. It is preferable that the antenna circuit have a rectifier circuit.

As in Embodiment Mode 1, there are no particular limitations on the shape of the antenna that can be used in the present embodiment mode. For this reason, an electromagnetic coupling method, an electromagnetic induction method, an electromagnetic wave method, an optical method, or the like can be used as a signal transmission method applied to the antenna circuit 1002 in the response device 1000. Preferably, an electromagnetic coupling method, an electromagnetic induction method, or an electromagnetic wave method is used. The implementer should select the transmission method, as appropriate, in consideration of the intended use, and an antenna with the most appropriate length and shape for the transmission method selected should be provided. An electromagnetic wave method can be used for the signal transmission method in the present invention, and further, a microwave method can be used, as well. For a shape of an antenna that can be used, for example, any of the shapes shown in FIGS. 12A to 12E can be used.

The demodulation circuit 1003 demodulates the alternating current electrical signal that is converted by the antenna circuit 1002 and transmits the demodulated signal to the control circuit 1006. It is to be noted that the demodulation circuit 1003 need not be provided if there is no particular need for it.

The clock generation circuit 1004 supplies a clock signal needed for operation of the control circuit 1006, the memory circuit 1007, and the encoding circuit 1008. For examples of the structure of the circuit, the structure may be set to be an oscillation circuit or a frequency divider circuit.

The power supply circuit 1005 generates a power supply voltage using alternating current electrical signals converted by the antenna 1002 and supplies a power supply voltage needed for operation to each circuit.

The control circuit 1006 performs analysis of commands and control of the memory circuit 1007 based on signals demodulated by the demodulation circuit 1003 and performs output and the like to the modulation circuit 1009 of data to be transmitted to external.

The memory circuit 1007 should be a kind of memory that can store information that the response device 1000 should have. The memory circuit 1007 has a circuit with a memory element and a control circuit that writes and reads out data based on the control circuit 1006. At the very least, individualized identification information (ID) about the response device itself is stored in the memory circuit 1007. The individualized identification information (ID) is used to differentiate among response devices (among different response devices that are worn by the user as well as response devices that are worn by people other than the user). In addition, the memory circuit 1007 has one or a plurality of kinds of memory selected from organic memory, dynamic random access memory (DRAM), static random access memory (SRAM), ferroelectric random access memory (FeRAM), mask read only memory (mask ROM), programmable read only memory (PROM), electrically programmable read only memory (EPROM), electrically erasable programmable read only memory (EEPROM), and flash memory. If the content of the memory is to be specific information (individualized identification information (ID) or the like) about the response device 1000, non-volatile memory, which can retain what is stored in memory even if a power supply is not supplied, should be used; if the content of the memory is to be temporarily retained whenever the response device 1000 performs data processing, volatile memory may be used.

Because organic memory has a simple structure in which a layer that contains an organic compound is interposed between a pair of conductive layers, there are at least two advantages to using organic memory. One advantage is that the manufacturing process can be simplified and costs can be reduced. Another advantage is that the area of a stack of layers can easily be made smaller and mass-production can easily be realized. Because of these advantages, using organic memory in the memory circuit 1007 is preferable.

The encoding circuit 1008 transforms all or a part of the data that is extracted from the memory circuit 1007 and data that is transmitted to the interrogator 1030 from the response device into an encoded signal. It is to be noted that the encoding circuit 1008 need not be provided if there is no particular need for it.

The modulation circuit 1009 adds load modulation to the antenna circuit 1002 based on signals encoded by the encoding circuit 1008.

A charge and discharge circuit 1010 may have a function used to adjust the voltage input from the antenna circuit 1002 to a more appropriate level of voltage when the amount of voltage is too excessive. Furthermore, it is preferable that the charge and discharge circuit 1010 have a function used to stop charging of a battery 1011 whenever the voltage of the battery 1011 reaches or exceeds a default value so that the battery 1011 does not become overcharged.

The battery 1011 is a battery for which the amount of time for continuous use can be restored by charging. It is to be noted that, for the battery, for example, secondary batteries such as lithium ion batteries, lithium secondary batteries, nickel-metal hydride batteries, nickel-cadmium batteries, organic radical batteries, lead storage batteries, air secondary batteries, nickel-zinc batteries, silver-zinc batteries, and the like can be used; however, the type of battery to be used in the present invention is not limited to those listed. Preferably, a battery formed as a sheet is used. Preferably, a lithium polymer battery, a lithium ion battery, or the like that uses a gel electrolyte is used. By use of these batteries that have large charge and discharge capacities, miniaturization becomes possible; however, the type of battery to be used in the present invention is not limited to these, and any type may be used as long as it is a rechargeable battery. In exchange for a battery, a capacitor with a large capacity or the like may be used. It is to be noted that the charging of the battery 1011 can be performed wirelessly.

It is to be noted that, by formation of an active material and electrolyte material of the lithium ion battery by a sputtering method, the battery 1011 may be formed over the same substrate as the substrate in the response device over which the circuit elements are formed or it may be formed over the same substrate as the substrate over which the antenna circuit is formed. By formation of the battery 1011 over the substrate over which the circuit elements or the antenna is formed, yield can be improved. In a metal lithium battery, a transition metal oxide with a lithium ion component, a metal oxide, a metal sulfide, an iron-based compound, a conductive polymer, an organic sulfur-based compound, or the like is used for the active material of the cathode, lithium (a lithium alloy) is used for the active material of the anode, and an organic electrolyte, a polymer electrolyte, or the like is used for the electrolyte, whereby a battery with an even greater charge and discharge capacity can be used.

As described above, by installation of a battery into the response device of the present invention, even if a sufficient amount of voltage cannot be secured for the response device to transmit a signal, the response device can be made to operate most assuredly. In particular, when an optical method is used for the transmission method of the signal, electric power being supplied wirelessly and stored in a battery by the present invention is extremely effective. It is to be noted that the response device described in the present embodiment mode can have the structure of a response device described in any other embodiment mode. As a result, the merits of these response devices can be enjoyed.

(Embodiment Mode 5)

It is assumed that a central response device of any of Embodiment Mode 1 through Embodiment Mode 4 is worn by a user.

The central response device may be attached to the user by implantation into the body of the user or by some other method, or it may be inserted into an object that is to be worn that is worn by the user. When the central response device is implanted into the user, an object not often removed should be selected for the object that is to be worn that is worn by the user. Even more preferably, an object that cannot be removed should be selected. By implantation into the user, the effectiveness of the present invention can be increased.

The present embodiment mode can be freely combined with any of the embodiment modes described above.

(Embodiment Mode 6)

In the present embodiment mode, a structure of an aspect of the present invention that has even more added value than the structure described in the above embodiment modes will be described. Specifically, the central response device is installed in a metal accessory or the like, and the accessory that is electrically connected to the central response device is used as an antenna.

Figure 11A:
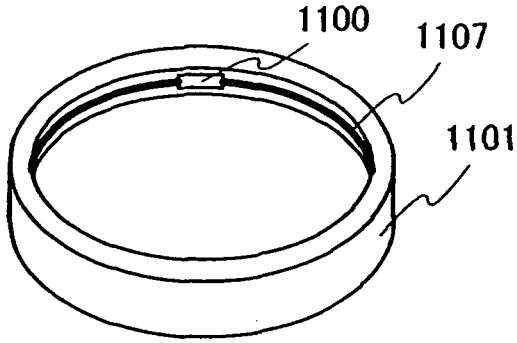
FIGS. 11A to 11C are diagrams used to describe one aspect of a response device used in the present invention.
Figure 11B:
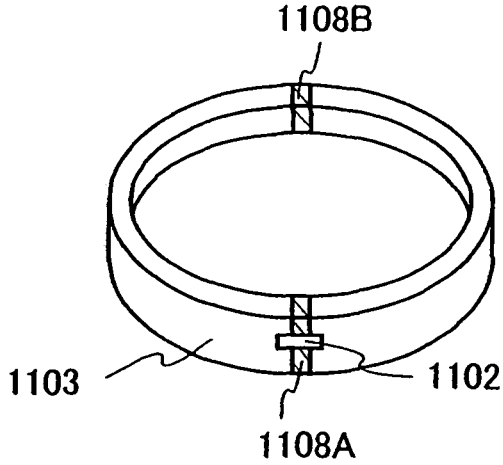
Figure 11C:
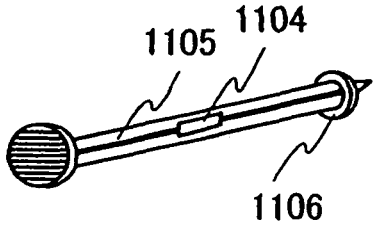

An object that is to be worn, in which the central response device of the present embodiment mode is installed, is shown in each of FIGS. 11A to 11C. For the central response device, a central response device 1100, a central response device 1102, or a central response device 1104, each with the same structure as that of the response device 200 described in Embodiment Mode 1, are used. FIG. 11A shows a ring 1101 used for the object that is to be worn, in which the central response device 1100 is installed. FIG. 11B shows a ring 1103 used for the object that is to be worn, in which the central response device 1102 is installed. FIG. 11C shows an earring 1105 and an earring clutch 1106 used for the object that is to be worn, in which the central response device 1104 is installed.

It is to be noted that, for the ring 1101 shown in FIG. 11A, an antenna 1107 of the central response device 1100 is attached to the inner side of the ring 1101. It is preferable that an insulator be provided between the antenna and the ring 1101. For the ring 1103 shown in FIG. 11B, the central response device 1102 is attached to the outer side of the ring 1103, an external terminal of the central response device 1102 is connected to the ring 1103, and the ring 1103 functions as an antenna. In order to make the ring 1103 function as an antenna, as shown by a hatched pattern in FIG. 11B, an insulator 1108A and an insulator 1108B are provided where required to electrically insulate the ring 1103 from the central response device 1102.

Because there are no limitations, in particular, on the shape of the antenna that can be used in the present invention, an electromagnetic coupling method, an electromagnetic induction method, an electromagnetic wave method, or the like can be used as a signal transmission method applied to the antenna circuit in the response device. The implementer should select the transmission method, as appropriate, in consideration of the intended use, and an antenna with the most appropriate length and shape for the transmission method selected should be provided. Preferably, an electromagnetic wave method may be used for the signal transmission method in the present invention; even more preferably, a microwave method may be used.

For example, when an electromagnetic coupling method or electromagnetic induction method (for example, at the 13.56 MHz band) is applied for the transmission method, the conductive film that functions as an antenna is formed into a ring shape (for example, as a loop antenna) or a spiral shape (for example, as a spiral antenna) because electromagnetic induction by change in electric field density is used.

Furthermore, when a microwave method (for example, at the UHF band (the 860 MHz to 960 MHz band), the 2.45 GHz band, or the like), which is one type of electromagnetic wave method, is applied for the transmission method, the most appropriate length and shape of a conductive film that functions as an antenna should be selected in consideration of the wavelength of the electromagnetic waves used for the transmission of signals. For example, the conductive film that functions as an antenna can be formed into a linear shape (for example, as a dipole antenna), a planar shape (for example, as a patch antenna), or the like. Furthermore, the shape of the conductive film that functions as an antenna is not limited to being a linear shape but may be a curved shape, a serpentine shape, or a combination of any of these, in consideration of the wavelength of the electromagnetic waves used.

Here, some examples of the shape of the antenna provided in the antenna circuit are shown in FIGS. 12A to 12E. For example, the structure may be set as one in which, as shown in FIG. 12A, one surface of the antenna 1201 is arranged all around the chip 1200 that is provided in a signal processing circuit. Alternatively, the structure may be set as one in which, as shown in FIG. 12B, the thin antenna 1203 is arranged all around the chip 1202 that is provided in a signal processing circuit in such a way that the antenna 1203 winds around the perimeter of the chip 1202. Furthermore, the shape of the antenna may be arranged like that of the antenna 1205, which is used to receive high-frequency electromagnetic waves, with respect to the chip 1204 that is provided in a signal processing circuit as shown in FIG. 12C. Moreover, the shape of the antenna may be arranged like that of the antenna 1207, which is omnidirectional (can receive signals from any direction) in 180°, with respect to the chip 1206 that is provided in a signal processing circuit, as shown in FIG. 12D. Preferably, as shown in FIG. 12E, the shape of the antenna is arranged like that of the antenna 1209, which extends out into a rod-like shape, with respect to the chip 1208 that is provided in a signal processing circuit. For the antenna circuit, an antenna of one of these shapes or a combination of any of these shapes can be used.

Furthermore, as shown in FIGS. 12A to 12E, there are no limitations, in particular, on the method for connection of the chip 1200, and the like, provided in a signal processing circuit and the antenna 1201 and the like. If FIG. 12A is given as an example, the antenna 1201 and the chip 1200 that is provided in a signal processing circuit may be connected to each other by a wire bonding connection or a solder bump connection or by a method in which a part of the chip is attached to the antenna 1201 as an electrode. With this method, the chip 1200 can be attached to the antenna 1201 using an anisotropic conductive film (ACF). In addition, the optimal length for the required length of the antenna differs depending on the frequency of the received signals. For example, if the frequency is 2.45 GHz, the length of the antenna should be about 60 mm (half of the wavelength) or about 30 mm (one-fourth of the wavelength). Preferably, when the frequency is 900 MHz, data may be transmitted and received by an electromagnetic wave method using an antenna with a length greater than or equal to 100 mm and less than or equal to 150 mm.

In the present embodiment mode, each central response device may be installed by attachment or the like to the inner side or outer side of each object that is to be worn or installed by implantation into the object that is to be worn.

The accessory into which the central response device is installed is not limited to being metal; the accessory is not limited to being formed of any particular material or shape, as long as the material is a conductive material that can be used as an antenna It is preferable that the antenna of the present embodiment mode be substituted for with an accessory.

This kind of accessory is represented by a ring that is partially or completely made of metal. An earring that is partially or completely made of metal may also be used. The main body of an accessory, such as a ring, an earring, or the like, partially or completely made of metal can be used as an antenna that is electrically connected to the response device. Furthermore, for a response device that has an antenna, the antenna and the accessory may be connected to each other electrically. By installation of the central response device into a ring, an earring, or the like that is worn on the body, in close contact, the possibility of losing the central response device itself can be decreased.

By use of the present invention, because the central response device that is worn by a human being (a user) and the central management device that has the controller and the interrogator, are each provided separately, loss of the central management device, which has the controller and the interrogator, of the article management system, itself can be prevented.

By use of the present invention, the article management system can be made to function more assuredly without any loss of the central management device. For this reason, management of articles can be carried out more easily and more efficiently. Consequently, loss of articles can be prevented, and financial losses can be prevented, as well. Furthermore, damage resulting from crime such as theft or the like can be prevented, as well.

Moreover, loss of the central response device can be prevented and the reliability of the article management system can be improved by the article that is to be worn being incorporated into an object that is not often removed or by being attached to a human being (a user).

Moreover, as described in the present embodiment mode, loss of the central response device can be prevented and the reliability of the article management system can be improved by the article that is to be worn being installed in an object that is not often removed or by being attached to a human being (a user).

Furthermore, as described in the present embodiment mode, by the conductive article to be attached that is worn by the user and the element formation portion of the central response device being electrically connected and used as an antenna of the central response device, the response device can be miniaturized and the article management system can be made to operate even more effectively.

The present embodiment mode can be freely combined with any of the embodiment modes described above.

[Embodiment 1]

In the present embodiment, examples of applications of the present invention will be described with reference to drawings.

Figure 13A:
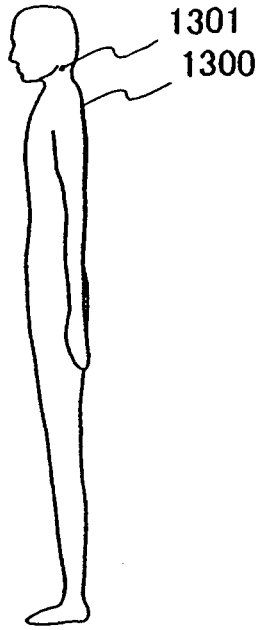
FIGS. 13A to 13C are diagrams used to describe examples of applications of the present invention.

FIG. 13A is a diagram that illustrates a central response device 1301 that is implanted into the body 1300 of a human being. By mounting, by implantation or the like, of the central response device of the present invention into the body of a human being, the present invention can be used even more effectively.

Figure 13B:
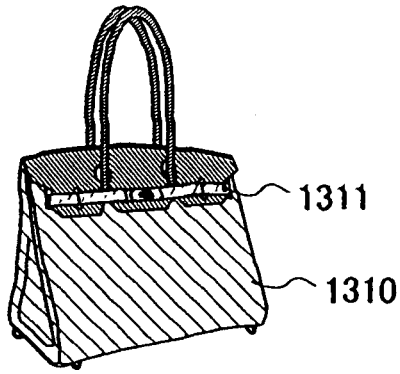
Figure 13C:
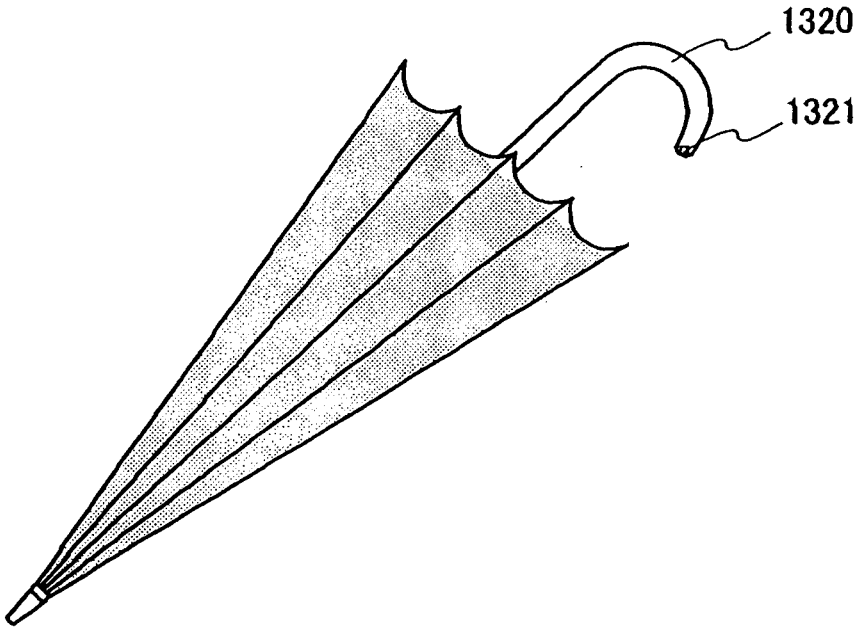

FIG. 13B is a diagram that illustrates a response device 1311 that is attached to a bag 1310. FIG. 13C is a diagram that illustrates a response device 1321 that is attached to an umbrella 1320. By attachment or the like of a response device installed in an article of the present invention to an umbrella, a bag, or the like, loss of the umbrella, bag, or the like can be prevented.

Figure 14A:
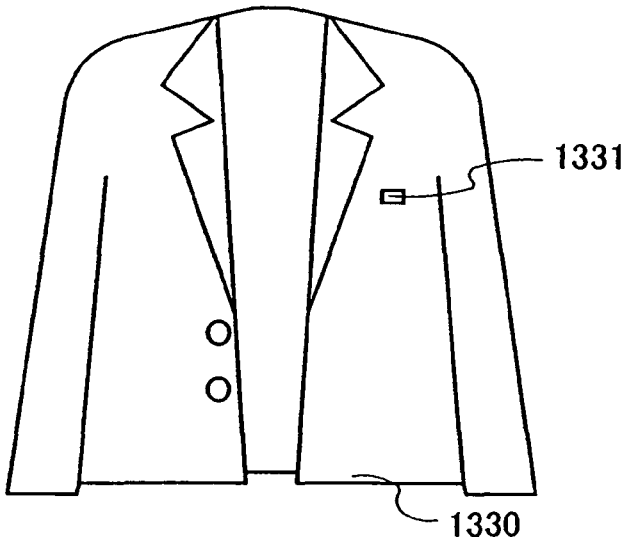
FIGS. 14A to 14D are diagrams used to describe examples of applications of the present invention.

FIG. 14A is a diagram that illustrates the installation of a response device 1331 that is installed in an article of the present invention into the pocket of a jacket 1330. If a response device installed in an article of the present invention is inserted into a jacket, loss of the jacket can be prevented.

Figure 14B:
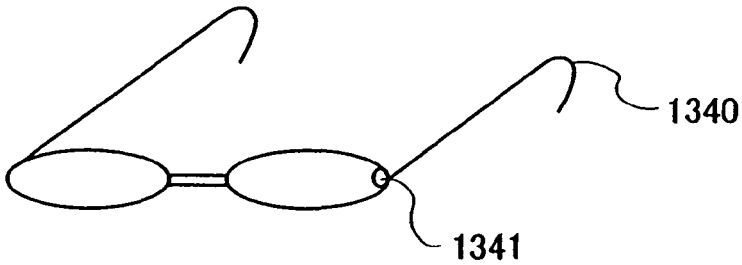

FIG. 14B illustrates the installation of a central response device 1341 into the rim of a pair of eyeglasses 1340. If a central response device of the present invention is installed in a pair of eyeglasses, an article not often removed, the present invention can be used even more effectively.

Figure 14C:
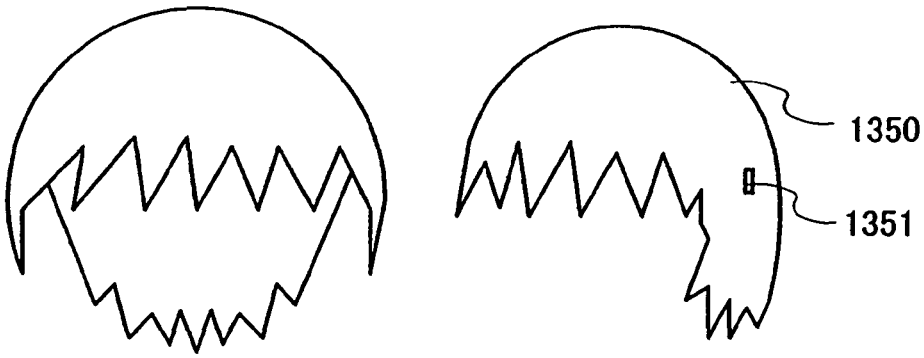

FIG. 14C is a diagram that illustrates the installation of a central response device 1351 into a wig 1350, which is a personal accessory. If a central response device of the present invention is installed in a wig, an article not often removed, the present invention can be used particularly effectively.

It is to be noted that when a central response device is installed in a wig, installing the central response device into the side touching a person's body is preferable for external appearances. If the central response device is installed in the wig on a side that does not touch a person's body, the central response device should be installed in the back part or side of the head as shown in FIG. 14C, most preferably, in the back part of the head, rather than on the front or top of the head. If a central response device of the present invention is installed in a wig, resistance to shock improves, and therefore, the present invention is favorable.

Figure 14D:
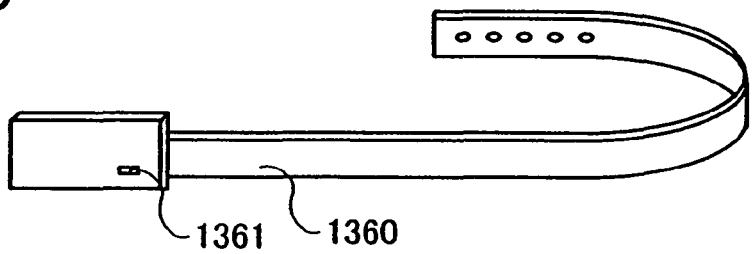

FIG. 14D illustrates the installation of a central response device 1361 into the buckle of a belt 1360. If a central response device of the present invention is installed in a belt, an article not often removed, the present invention can be used even more effectively.

This application is based on Japanese Patent Application serial no. 2006-308096 filed with the Japan Patent Office on Nov. 14, 2006, the entire contents of which are hereby incorporated by reference.

REFERENCE NUMERALS

100, user; 101, central response device; 102, central management device; 103, interrogator; 104, detector; 105, alarm portion; 108, controller; 111 substrate; 112, insulating layer; 113, plurality of transistors; 114, insulating layer; 115, insulating layer; 116, insulating layer; 117 to 124, conductive layers; 125, insulating layer; 126, region; 127, semiconductor layer; 129, conductive layer; 130, impurity region; 131, channel formation region; 132, groove; 133, stacked-layer body; 134, film; 135, film; 200, response device; 202, antenna circuit; 203, demodulation circuit; 204, clock generation circuit; 205, power supply circuit; 206, control circuit; 207, memory circuit; 208, encoding circuit; 209, modulation circuit; 301, receiver; 302, transmitter; 303, controller; 304, interface; 305A, antenna circuit; 305B, antenna circuit; 306, upper-level device; 307A, antenna; 307B, antenna; 308A, resonant circuit; 308B, resonant circuit; 401, first input; 402, second input; 403, output; 404, operational amplifier; 405, reference voltage power supply; 406, first resistor; 407, second resistor; 408, output; 501, input; 502, amplifier; 503, output; 504, input; 505, amplifier, 506, vibrator; 600, lead part; 601, individualized identification information (ID) part; 603, data identification evaluation part; 604, end part; 610, step; 611, step; 612, step; 613, step; 614, step; 615, step; 616, step; 617, step; 618, step; 619, step; 700, user; 701, central response device; 702, central management device; 703, interrogator; 704, detector; 705, alarm portion; 706A, response device for an article; 706B, response device for an article; 706N, response device for an article; 707A, article; 707B, article; 707N, article; 708, controller; 751, main body; 754, operation keys; 755, audio output; 756, audio input; 757, circuit substrate; 758, display panel (A); 759, display panel (B); 760, hinge; 761, transparent material; 763, central management device; 771, main body; 772, case; 773, display panel; 774, operation keys; 775, audio output; 776, audio input; 779, portable reader/writer; 781, case; 782, display; 783, display; 784, speaker; 785, operation keys; 786, storage media insertion portion; 787, central management device; 788, sensor; 789, microphone; 790, LED lamp; 801, receiver; 802, transmitter; 803, controller; 804, interface; 805A, antenna circuit; 805B, antenna circuit; 806, upper-level device; 807A, antenna; 807B, antenna; 808A, resonant circuit; 808B, resonant circuit; 900, lead part; 901, individualized identification information (ID) part; 902, individualized identification information (ID) part; 903, data identification evaluation part; 904, end part; 910, step; 911, step; 912, step; 913, step; 914, step; 915, step; 916, step; 917, step; 918, step; 919, step; 921, step; 922, step; 1000, response device; 1002, antenna circuit; 1003, demodulation circuit; 1004, clock generation circuit; 1005, power supply circuit; 1006, control circuit; 1007, memory circuit; 1008, encoding circuit; 1009, modulation circuit; 1010, charge and discharge circuit; 1011, battery; 1030, interrogator; 1100, central response device; 1101, ring; 1102, central response device; 1103, ring; 1104, central response device; 1105, earring; 1106, earring clutch; 1107, antenna; 1108A, insulator; 1108B, insulator; 1200, chip; 1201, antenna; 1202, chip; 1203, antenna; 1204, chip; 1205, antenna; 1206, chip; 1207, antenna; 1208, chip; 1209, antenna; 1300, body of a human being; 1301, central response device; 1310, bag; 1311, response device; 1320, umbrella; 1321, response device; 1330, jacket; 1331, response device; 1340, pair of eyeglasses; 1341, central response device; 1350, wig; 1351, central response device; 1360, belt; 1361, central response device; 1900, user; 1901, central response device; 1902, central response device; 1903, interrogator; 1904, detector; 1905, alarm portion; 1910, response device; 2000, user; 2001, central response device; 2002, central response device; 2003, interrogator; 2004, detector; 2005, alarm portion; 2006A, response device for an article; 2006B, response device for an article; 2006N, response device for an article; 2007A, article; 2007B, article; and 2007N, article.

The invention claimed is:

1. An article management system, comprising:

a central response device incorporated into a first article, wherein the first article is configured to be worn by a user;

a response device incorporated into a second article;

a central management device incorporated into a third article, wherein the central management device can communicate with the central response device wirelessly, wherein the first article is less frequently removed from the user than the second article and the third article, and wherein the central management device comprises:

an interrogator that communicates wirelessly with the central response device and with the response device, wherein the central response device comprises:

a detector that detects a communication distance between the interrogator and the central response device; and an alarm portion that notifies the user when the communication distance detected by the detector reaches or exceeds a standard value, wherein the central response device is installed in a metal accessory, and wherein the metal accessory is electrically connected to the central response device, and is used as an antenna.

2. The article management system according to claim 1, further comprising a controller that controls the central management device.

3. The article management system according to claim 1, further comprising a second response device incorporated into a fourth article, wherein the interrogator communicates wirelessly with the second response device incorporated into the fourth article.

4. The article management system according to claim 1, wherein the response device incorporated into the second article is a semiconductor device.

5. The article management system according to claim 1, wherein the central response device is a semiconductor device.

6. The article management system according to claim 1, wherein the central response device comprises a battery that can be charged up wirelessly.

7. The article management system according to claim 1, wherein the first article implanted into the user comprises a conductive material, and the conductive material functions as an antenna for the central response device.

8. An article management system, comprising:

a central response device incorporated into a first article, wherein the first article is configured to be worn by a user;

a response device incorporated into a second article, wherein the response device includes an antenna circuit;

a central management device incorporated into a third article, wherein the central management device can communicate with the central response device wirelessly, wherein the first article is less frequently removed from the user than the second article and the third article, and wherein the central management device comprises:

an interrogator that communicates wirelessly with the central response device and with the response device, wherein the central response device comprises:

a detector that detects a communication distance between the interrogator and the central response device; and an alarm portion that notifies the user when the communication distance detected by the detector reaches or exceeds a standard value, wherein the central response device is installed in a metal accessory, and wherein the metal accessory is electrically connected to the central response device, and is used as an antenna.

9. The article management system according to claim 8, further comprising a controller that controls the central management device.

10. The article management system according to claim 8, further comprising a second response device incorporated into a fourth article, wherein the interrogator communicates wirelessly with the second response device incorporated into the fourth article.

11. The article management system according to claim 8, wherein the response device incorporated into the second article is a semiconductor device.

12. The article management system according to claim 8, wherein the central response device is a semiconductor device.

13. The article management system according to claim 8, wherein the central response device comprises a battery that can be charged up wirelessly.

14. The article management system according to claim 8, wherein the first article implanted into the user comprises a conductive material, and the conductive material functions as an antenna for the central response device.

15. The article management system according to claim 1, wherein the second article is a bag, an umbrella or a jacket.

16. The article management system according to claim 1, wherein the third article is a cellular telephone.

17. The article management system according to claim 8, wherein the second article is a bag, an umbrella or a jacket.

18. The article management system according to claim 8, wherein the third article is a cellular telephone.

19. The article management system according to claim 1, wherein the first article worn by the user is a ring, a buckle of a belt or an earring.

20. The article management system according to claim 8, wherein the first article worn by the user is a ring, a buckle of a belt or an earring.

21. The article management system according to claim 1, wherein the alarm portion notifies the user by applying an electric current to the user, and wherein the electric current applied to the user is set to be greater than or equal to 1 mA and less than 20 mA.

22. The article management system according to claim 8, wherein the alarm portion notifies the user by applying an electric current to the user, and wherein the electric current applied to the user is set to be greater than or equal to 1 mA and less than 20 mA.

* * * * *

UNITED STATES PATENT AND TRADEMARK OFFICE

CERTIFICATE OF CORRECTION

PATENT NO. : 8,427,306 B2
APPLICATION NO. : 11/979993
DATED : April 23, 2013
INVENTOR(S) : Mizoguchi et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 253 days.

Signed and Sealed this
Twenty-seventh Day of October, 2015

Michelle K. Lee

Michelle K. Lee
*Director of the United States Patent and Trademark Office*